US011397030B2

(12) United States Patent
Thatte et al.

(10) Patent No.: US 11,397,030 B2
(45) Date of Patent: Jul. 26, 2022

(54) LOW ENERGY CONSUMPTION REFRIGERATION SYSTEM WITH A ROTARY PRESSURE EXCHANGER REPLACING THE BULK FLOW COMPRESSOR AND THE HIGH PRESSURE EXPANSION VALVE

(71) Applicant: Energy Recovery, Inc., San Leandro, CA (US)

(72) Inventors: Azam Mihir Thatte, Kensington, CA (US); Matthew Joseph Pattom, Fremont, CA (US)

(73) Assignee: Energy Recovery, Inc., San Leandro, CA (US)

( * ) Notice: Subject to any disclaimer, the term of this patent is extended or adjusted under 35 U.S.C. 154(b) by 165 days.

(21) Appl. No.: 16/926,368

(22) Filed: Jul. 10, 2020

(65) Prior Publication Data

US 2022/0011023 A1 Jan. 13, 2022

(51) Int. Cl.
*F25B 9/00* (2006.01)
*F25B 31/02* (2006.01)
(Continued)

(52) U.S. Cl.
CPC ..... *F25B 9/008* (2013.01); *F25B 13/00* (2013.01); *F25B 31/026* (2013.01); *F25B 39/00* (2013.01);
(Continued)

(58) Field of Classification Search
CPC ..... F25B 9/008; F25B 13/00; F25B 31/026; F25B 39/00; F25B 41/22; F25B 41/31;
(Continued)

(56) References Cited

U.S. PATENT DOCUMENTS 2,952,138 A * 9/1960 Russell ..... F25B 27/00 165/61
2,971,343 A * 2/1961 Spalding ..... F04F 13/00 62/88
(Continued)

FOREIGN PATENT DOCUMENTS

CN 101290174 A 10/2008
EP 3489595 A1 5/2019
(Continued)

OTHER PUBLICATIONS

International Search Report and Written Opinion dated Oct. 6, 2021, for International Application No. PCT/US2021/040201.
(Continued)

*Primary Examiner* — Eric S Ruppert
*Assistant Examiner* — Kirstin U Oswald
(74) *Attorney, Agent, or Firm* — Lowenstein Sandler LLP

(57) ABSTRACT

A refrigeration system includes a rotary pressure exchanger fluidly coupled to a low pressure loop and a high pressure loop. The rotary pressure exchanger replaces a traditional bulk flow compressor. The rotary pressure exchanger is configured to receive the refrigerant at high pressure from the high pressure loop, to receive the refrigerant at low pressure from the low pressure loop, and to exchange pressure between the refrigerant at high pressure and the refrigerant at low pressure, and wherein a first exiting stream from the rotary pressure exchanger includes the refrigerant at high pressure in the supercritical state or the subcritical state and a second exiting stream from the rotary pressure exchanger includes the refrigerant at low pressure in the liquid state or the two-phase mixture of liquid and vapor.

7 Claims, 22 Drawing Sheets

(51) Int. Cl.
*F25B 39/00* (2006.01)
*F25B 13/00* (2006.01)
*F25B 41/22* (2021.01)
*F25B 41/31* (2021.01)

(52) U.S. Cl.
CPC ..... *F25B 41/22* (2021.01); *F25B 41/31* (2021.01); *F25B 2313/02732* (2013.01)

(58) Field of Classification Search
CPC .... F25B 2313/02732; F25B 2600/2513; F25B 7/00; F25B 41/30; F25B 40/00; F25B 1/10; F25B 5/02; F25B 49/02; F25B 2309/005; F25B 2309/02; F25B 2309/061
USPC ..... 62/498
See application file for complete search history.

(56) References Cited

U.S. PATENT DOCUMENTS 3,158,007 A * 11/1964 Kentfield ..... F04F 13/00 60/516
3,347,059 A * 10/1967 Laing ..... F28F 5/04 165/92
3,503,207 A * 3/1970 Strub ..... G21D 5/06 60/671
3,696,634 A * 10/1972 Ludin ..... F25B 3/00 165/92
3,740,966 A * 6/1973 Pravda ..... F25B 15/004 62/499
3,823,573 A * 7/1974 Cassady ..... F04B 35/00 62/243
3,854,301 A * 12/1974 Cytryn ..... F25B 15/00 60/645
3,988,901 A * 11/1976 Shelton ..... F25B 1/00 62/116
4,000,778 A * 1/1977 Laing ..... F24F 12/002 165/104.31
4,006,602 A * 2/1977 Fanberg ..... F25B 31/00 62/505
4,051,888 A * 10/1977 Yamada ..... F25D 5/00 126/263.01
4,442,677 A * 4/1984 Kauffman ..... F25B 15/12 62/476
4,512,394 A * 4/1985 Kauffman ..... C02F 1/16 165/DIG. 158
4,524,587 A * 6/1985 Kantor ..... F01K 11/04 62/499
4,823,560 A * 4/1989 Rowley ..... F04B 9/115 60/593
4,887,942 A 12/1989 Hauge
5,336,059 A * 8/1994 Rowley ..... F04C 23/003 60/671
5,503,222 A * 4/1996 Dunne ..... F24F 3/1423 62/480
5,802,870 A * 9/1998 Arnold ..... F25B 17/083 62/480
6,158,237 A * 12/2000 Riffat ..... F21V 29/00 165/92
6,178,767 B1 * 1/2001 Pravda ..... F28D 15/04 62/310
6,250,086 B1 6/2001 Cho
6,389,818 B2 5/2002 Cho
6,484,519 B1 * 11/2002 Hesse ..... F25B 11/02 62/116
6,773,226 B2 * 8/2004 Al-Hawaj ..... B01D 61/10 91/499
7,207,186 B2 4/2007 Hirota
8,075,281 B2 * 12/2011 Martin ..... B01D 61/10 417/69
9,243,850 B1 * 1/2016 Bastian ..... F28F 9/02
9,388,817 B1 7/2016 Wright et al.
9,695,795 B2 * 7/2017 Martin ..... F03B 13/00
9,897,336 B2 * 2/2018 Staffend ..... F01K 23/06
9,920,774 B2 3/2018 Ghasripoor et al.
10,041,701 B1 * 8/2018 Koplow ..... F28F 5/02
10,119,379 B2 11/2018 Richter et al.
10,167,710 B2 1/2019 Ghasripoor et al.
10,359,075 B2 * 7/2019 Anderson ..... E21B 43/26
10,557,482 B2 2/2020 Anderson
10,766,009 B2 * 9/2020 Oklejas, Jr. ..... F04F 13/00
10,933,375 B1 * 3/2021 Oklejas, Jr. ..... F04F 13/00
10,989,021 B1 * 4/2021 Stephenson ..... E21B 43/267
11,073,169 B2 * 7/2021 Thatte ..... F01K 3/006
2001/0020366 A1 9/2001 Cho
2004/0250556 A1 12/2004 Sienel
2005/0044865 A1 * 3/2005 Manole ..... F25B 1/10 62/149
2006/0130495 A1 * 6/2006 Dieckmann ..... F04C 23/003 62/402
2006/0254308 A1 11/2006 Yokoyama et al.
2008/0078192 A1 * 4/2008 Ignatiev ..... F04C 18/0261 62/184
2009/0301109 A1 12/2009 Manole
2010/0024421 A1 2/2010 Litwin et al.
2011/0051880 A1 3/2011 Al-Mayahi et al.
2013/0145759 A1 6/2013 Sonwane et al.
2015/0184502 A1 * 7/2015 Krish ..... F04F 13/00 166/177.5
2015/0217622 A1 * 8/2015 Enomoto ..... B60H 1/00385 62/244
2015/0285101 A1 * 10/2015 Hikichi ..... F01K 17/02 60/670
2016/0047361 A1 2/2016 Al-Sulaiman
2016/0138649 A1 5/2016 Anderson
2016/0252289 A1 * 9/2016 Feng ..... F25B 25/005 165/121
2016/0298500 A1 10/2016 Peter et al.
2016/0377303 A1 * 12/2016 Staffend ..... F01C 13/04 165/45
2019/0153903 A1 5/2019 Miller
2019/0390576 A1 * 12/2019 Thatte ..... F01K 21/045

FOREIGN PATENT DOCUMENTS

KR 20190133595 A 12/2019
WO WO-2008000793 A1 * 1/2008 ..... F04B 41/06
WO 2008019689 A2 2/2008
WO 2011092705 A2 8/2011
WO 2017125251 A1 7/2017
WO 2022010750 A1 1/2022

OTHER PUBLICATIONS

Fricke, et al. "Increasing the Efficiency of a Carbon Dioxide Refrigeration System Using a Pressure Exchanger". Retrieved from <https.//www.osli.gov/biblio.1560413>, Aug. 1, 2021, 7 pages.
International Search Report and Written Opinion dated Jul. 1, 2020, for International Application No. PCT/US2019/039334.
U.S. Appl. No. 16/926,328, filed Jul. 10, 2020, Azam Mihir Thatte.
A Document entitled Increasing the efficiency of a carbon dioxide refrigeration system—using a 9-14, 16-20 pressure exchanger, retrieved from <https://www.osti.gov/biblio/1560431> (Frick et al.) Aug. 1, 2019 (Aug. 1, 2019), entire document, especially Fig 2c; p. 2.
International Search Report and Written Opinion received for PCT Application No. PCT/US2021/40201, dated Oct. 6, 2021.
Danish Search Report received form the Danish Patent Office for Application No. PA 2021 70360, dated May 4, 2022.

* cited by examiner

LOW ENERGY CONSUMPTION REFRIGERATION SYSTEM WITH A ROTARY PRESSURE EXCHANGER REPLACING THE BULK FLOW COMPRESSOR AND THE HIGH PRESSURE EXPANSION VALVE

BACKGROUND

This section is intended to introduce the reader to various aspects of art that may be related to various aspects of the present invention, which are described and/or claimed below. This discussion is believed to be helpful in providing the reader with background information to facilitate a better understanding of the various aspects of the present invention. Accordingly, it should be understood that these statements are to be read in this light, and not as admissions of prior art.

With enforcement from governmental environmental agencies, a large part of the world is now being forced to transition to zero global warming refrigeration systems like trans-critical carbon dioxide refrigeration. Trans-critical carbon dioxide systems work well in relatively cooler climates like most of the Europe and North America but face a drawback in hot climates as their coefficient of performance (a measure of efficiency) degrades as the ambient temperature of the surroundings get larger resulting in higher electricity costs per unit cooling performed. This is due to the much larger pressure that trans-critical carbon dioxide system needs to operate at (approximately 10,342 kPa (1500 psi) or greater) compared to HFC/CFC based systems (approximately 1,379-2068.4 kPa (200-300 psi)). To bring the refrigerant above the critical pressure a very high differential pressure compressor is utilized. The large pressure ratio across the compressor consumes more electrical energy. This problem is exaggerated in hotter climates as the refrigerant temperature at the inlet of the chiller needs to be increased to a sufficiently high temperature to enable rejection of heat to the surrounding hotter environment. This is done by increasing pressure ratio across the compressor even higher, thus creating an even larger electricity demand by the compressor and in turn increasing the electricity costs per unit cooling performed. Increased efficiency of refrigeration systems (e.g., trans-critical carbon dioxide refrigeration systems) may reduce the cost of operating the refrigeration equipment as well as increase its availability, while helping reduce global warming.

BRIEF DESCRIPTION

Certain embodiments commensurate in scope with the disclosed subject matter are summarized below. These embodiments are not intended to limit the scope of the disclosure, but rather these embodiments are intended only to provide a brief summary of certain disclosed embodiments. Indeed, the present disclosure may encompass a variety of forms that may be similar to or different from the embodiments set forth below.

In an embodiment, a refrigeration system is provided. The refrigeration system includes a high pressure loop for circulating a refrigerant at a high pressure through it. The refrigeration system also includes a gas cooler or a condenser disposed along the high pressure loop, wherein the high pressure loop is configured to reject heat to the surroundings from the refrigerant at high pressure via the gas cooler or the condenser, and the refrigerant at high pressure is in a supercritical state or subcritical state. The refrigeration system further includes a low pressure loop for circulating the refrigerant at a low pressure through it. The refrigeration system yet further includes an evaporator disposed along the low pressure loop, wherein the low pressure loop is configured to absorb heat from the surroundings into the refrigerant at low pressure via the evaporator, and the refrigerant at low pressure is in a liquid state, a vapor state, or a two-phase mixture of liquid and vapor. The refrigeration system still further includes a compressor or pump configured to increase a pressure of the refrigerant from low pressure to high pressure. The refrigeration system even further includes a rotary pressure exchanger fluidly coupled to the low pressure loop and the high pressure loop, wherein the rotary pressure exchanger is configured to receive the refrigerant at high pressure from the high pressure loop, to receive the refrigerant at low pressure from the low pressure loop, and to exchange pressure between the refrigerant at high pressure and the refrigerant at low pressure, and wherein a first exiting stream from the rotary pressure exchanger includes the refrigerant at high pressure in the supercritical state or the subcritical state and a second exiting stream from the rotary pressure exchanger includes the refrigerant at low pressure in the liquid state or the two-phase mixture of liquid and vapor. The refrigeration system still further includes a high differential pressure (DP), low flow multi-phase leakage pump disposed between the low pressure loop and the high pressure loop, wherein the high DP, low flow multi-phase leakage pump is configured to pressurize leakage flow exiting a low pressure outlet of the rotary pressure exchanger and to pump the leakage flow back into high pressure loop via a high pressure inlet of the rotary pressure exchanger, and wherein the high DP, low flow multi-phase leakage pump is configured to pump the refrigerant in the liquid state, the supercritical state, or in the two-phase mixture of liquid and vapor.

In an embodiment, a refrigeration system is provided. The refrigeration system includes a high pressure loop for circulating a refrigerant at a high pressure through it. The refrigeration system also includes a gas cooler or a condenser disposed along the high pressure loop, wherein the high pressure loop is configured to reject heat to the surroundings from the refrigerant at high pressure via the gas cooler or the condenser, and the refrigerant at high pressure is in a supercritical state or subcritical state. The refrigeration system further includes a low pressure loop for circulating the refrigerant at a low pressure through it. The refrigeration system yet further includes an evaporator disposed along the low pressure loop, wherein the low pressure loop is configured to absorb heat from the surroundings into the refrigerant at low pressure via the evaporator, and the refrigerant at low pressure is in a liquid state, a vapor state, or a two-phase mixture of liquid and vapor. The refrigeration system still further includes a compressor or pump configured to increase a pressure of the refrigerant from low pressure to high pressure. The refrigeration system even further includes a rotary pressure exchanger fluidly coupled to the low pressure loop and the high pressure loop, wherein the rotary pressure exchanger is configured to receive the refrigerant at high pressure from the high pressure loop, to receive the refrigerant at low pressure from the low pressure loop, and to exchange pressure between the refrigerant at high pressure and the refrigerant at low pressure, and wherein a first exiting stream from the rotary pressure exchanger includes the refrigerant at high pressure in the supercritical state or the subcritical state and a second exiting stream from the rotary pressure exchanger includes the refrigerant at low pressure in the liquid state or the two-phase mixture of liquid and vapor. The refrigeration system still further includes a high differential pressure (DP), low flow leakage compressor disposed between the low pressure loop and the high pressure loop, wherein the high DP, low flow leakage compressor is configured to pressurize leakage flow exiting a low pressure outlet of the rotary pressure exchanger and to compress the leakage flow back into high pressure loop at a location both downstream of a high pressure outlet of the rotary pressure exchanger and upstream of the gas cooler/condenser, and wherein the high DP, low flow leakage compressor is configured to compress the refrigerant from a low pressure vapor state to a high pressure vapor state.

In an embodiment, a refrigeration system is provided. The refrigeration system includes a high pressure loop for circulating a refrigerant at a high pressure through it. The refrigeration system also includes a gas cooler or a condenser disposed along the high pressure loop, wherein the high pressure loop is configured to reject heat to the surroundings from the refrigerant at high pressure via the gas cooler or the condenser, and the refrigerant at high pressure is in a supercritical state or subcritical state. The refrigeration system further includes a low pressure loop for circulating the refrigerant at a low pressure through it. The refrigeration system yet further includes an evaporator disposed along the low pressure loop, wherein the low pressure loop is configured to absorb heat from the surroundings into the refrigerant at low pressure via the evaporator, and the refrigerant at low pressure is in a liquid state, a vapor state, or a two-phase mixture of liquid and vapor. The refrigeration system still further includes a compressor or pump configured to increase a pressure of the refrigerant from low pressure to high pressure. The refrigeration system even further includes a rotary pressure exchanger fluidly coupled to the low pressure loop and the high pressure loop, wherein the rotary pressure exchanger is configured to receive the refrigerant at high pressure from the high pressure loop, to receive the refrigerant at low pressure from the low pressure loop, and to exchange pressure between the refrigerant at high pressure and the refrigerant at low pressure, and wherein a first exiting stream from the rotary pressure exchanger includes the refrigerant at high pressure in the supercritical state or the subcritical state and a second exiting stream from the rotary pressure exchanger includes the refrigerant at low pressure in the liquid state or the two-phase mixture of liquid and vapor. The refrigeration system still further includes a high pressure, high flow, low differential pressure (DP) circulation compressor disposed downstream of the rotary pressure exchanger in the high pressure loop, wherein the high pressure, high flow, low DP circulation compressor is configured to circulate refrigerant in a vapor state or in a supercritical state. The refrigeration system yet further includes a low pressure, high flow, low DP circulation compressor disposed downstream of the evaporator in the low pressure loop, wherein the low pressure, high flow, low DP circulation compressor is configured to circulate refrigerant in the vapor state. The refrigeration system even further includes a high DP, low flow leakage compressor disposed between the low pressure low and the high pressure low, wherein the high DP, low flow leakage compressor is configured to pressurize an excess flow exiting a low pressure outlet of the rotary pressure exchanger and to compress the excess flow back into the high pressure low, and wherein the high DP, low flow leakage compressor to compress the refrigerant from a low pressure vapor state to a high pressure vapor state or to a supercritical state.

BRIEF DESCRIPTION OF THE DRAWINGS

Various features, aspects, and advantages of the present invention will become better understood when the following detailed description is read with reference to the accompanying figures in which like characters represent like parts throughout the figures, wherein.

DETAILED DESCRIPTION OF SPECIFIC EMBODIMENTS

Figure 1:
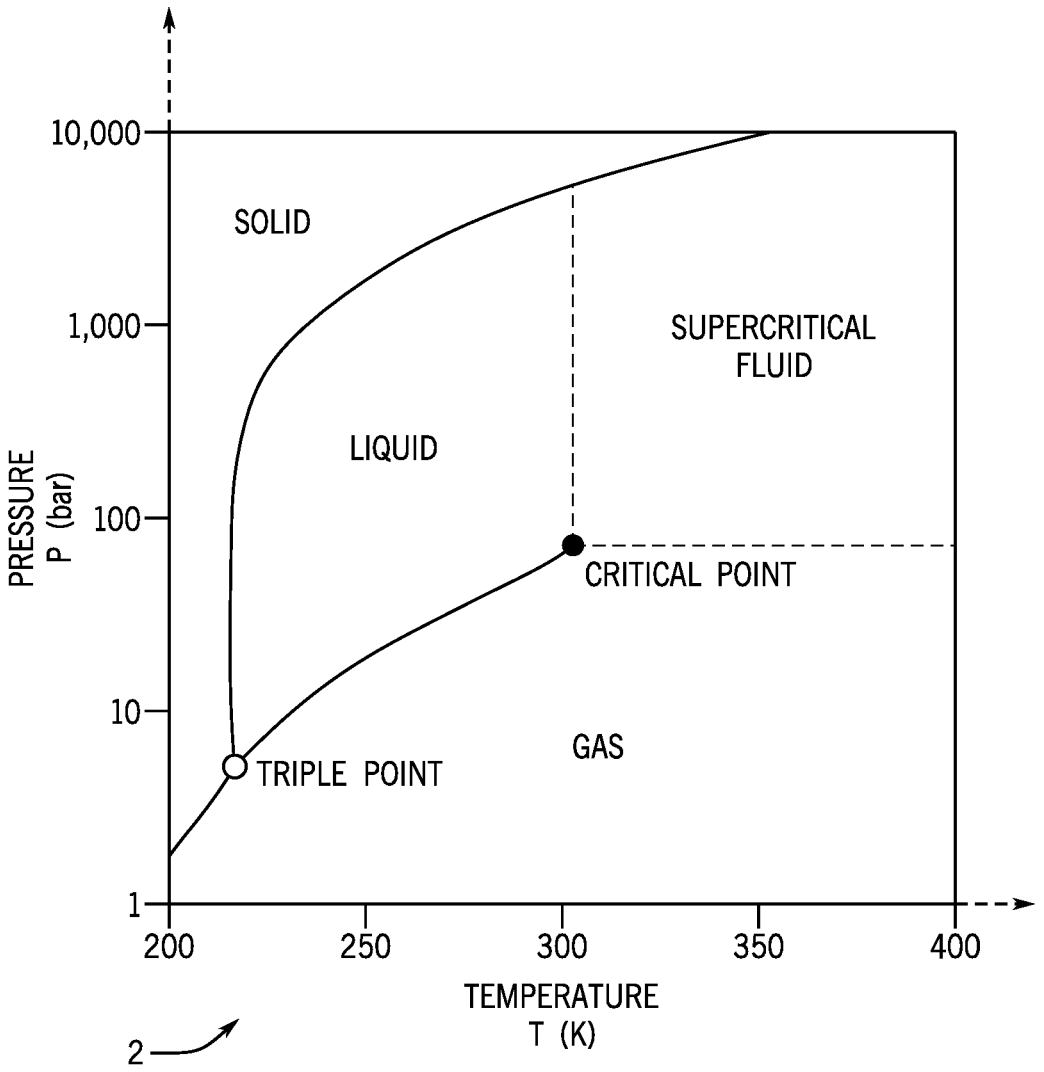
FIG. 1 is a phase diagram of carbon dioxide.

One or more specific embodiments of the present invention will be described below. These described embodiments are only exemplary of the present invention. Additionally, in an effort to provide a concise description of these exemplary embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

The discussion below describes a refrigeration system (e.g., trans-critical carbon dioxide refrigeration system) that utilizes a rotary pressure exchanger or a rotary liquid piston compressor or rotary liquid piston pump in place of a Joule-Thomson expansion valve. As will be explained below, the refrigeration system may operate more efficiently by increasing the cooling capacity of the refrigeration system, while recapturing a large portion of pressure energy that would otherwise be lost utilizing a Joule-Thomson expansion valve. Replacing the Joule-Thomson expansion valve with the rotary pressure exchanger increases efficiency due to getting rid of both the entropy generation and exergy destruction that occurs in the expansion valve which results in up to 40 percent of total losses in a typical refrigeration system. In addition, replacing the Joule-Thomson expansion valve with the rotary pressure exchanger increases efficiency by changing the expansion process from an isenthalpic (i.e., constant enthalpy) process across the expansion valve to an isentropic or close to isentropic (i.e., constant entropy) process across the rotary pressure exchanger. In certain embodiments, the rotary pressure exchanger may also replace the function of the bulk flow compressor. This enables one or more low differential pressure (DP) circulation compressors (blowers) or circulation pumps to be utilized in place of the bulk flow high differential pressure compressor and to maintain the flow within the refrigeration system (e.g., to overcome small pressure losses). These low DP circulation compressors may consume significantly less energy (e.g., by a factor of 10 or greater) than the bulk flow compressor. Replacing both the Joule-Thomson expansion valve and the bulk flow compressor with the rotary pressure exchanger removes two of the largest sources of inefficiencies in the refrigeration system while providing reduced power consumption and electricity costs. Further, utilization of the rotary pressure exchanger in place of the expansion valve and/or bulk flow compressor may increase the availability of the refrigeration system in other environments (e.g., warmer environments). Warmer ambient temperatures (e.g., 50 degrees Celsius) alter the compressor pressure ratio (by significantly increasing the pressure required at the exit of the compressor) and significantly reduce cycle efficiency (i.e., coefficient of performance) by as much as 60 percent compared to optimal temperatures (e.g., 35 degrees Celsius). The utilization of the rotary pressure exchanger mitigates the adverse effects of warmer environmental temperature on the compressor work required, the cooling capacity of the refrigeration system, and the coefficient of performance of the refrigeration system.

In operation, the rotary pressure exchanger or the rotary liquid piston compressor or pump may or may not completely equalize pressures between the first and second fluids. Accordingly, the rotary liquid piston compressor or pump may operate isobarically, or substantially isobarically (e.g., wherein the pressures of the first and second fluids equalize within approximately +/−1, 2, 3, 4, 5, 6, 7, 8, 9, or 10 percent of each other). Rotary liquid piston compressors or pumps may be generally defined as devices that transfer fluid pressure between a high-pressure inlet stream and a low-pressure inlet stream at efficiencies in excess of approximately 50%, 60%, 70%, 80%, or 90%

FIG. 1 is a phase diagram 2 of carbon dioxide. Phase diagrams represent equilibrium limits of various phases in a chemical system with respect to temperature and pressure. The phase diagram 2 of FIG. 1 illustrates how carbon dioxide changes phases (e.g., gas (vapor), liquid, solid, supercritical) as temperature and pressure changes. In addition to illustrating when carbon dioxide exists as a gas or vapor, a liquid, and a solid, the phase diagram 2 illustrates when carbon dioxide changes into supercritical fluid. When a compound is subjected to pressure and a temperature greater than its critical point it becomes a supercritical fluid. The critical point is the point at which surface tension (meniscus) that distinguishes the liquid and gas phases of a substance vanishes and the two phases become indistinguishable. In the supercritical region, the fluid exhibits particular properties. These properties may include gases having liquid-like (e.g., order of magnitude higher) densities, specific heats, viscosities, and speed of sound through them.

Figure 2:
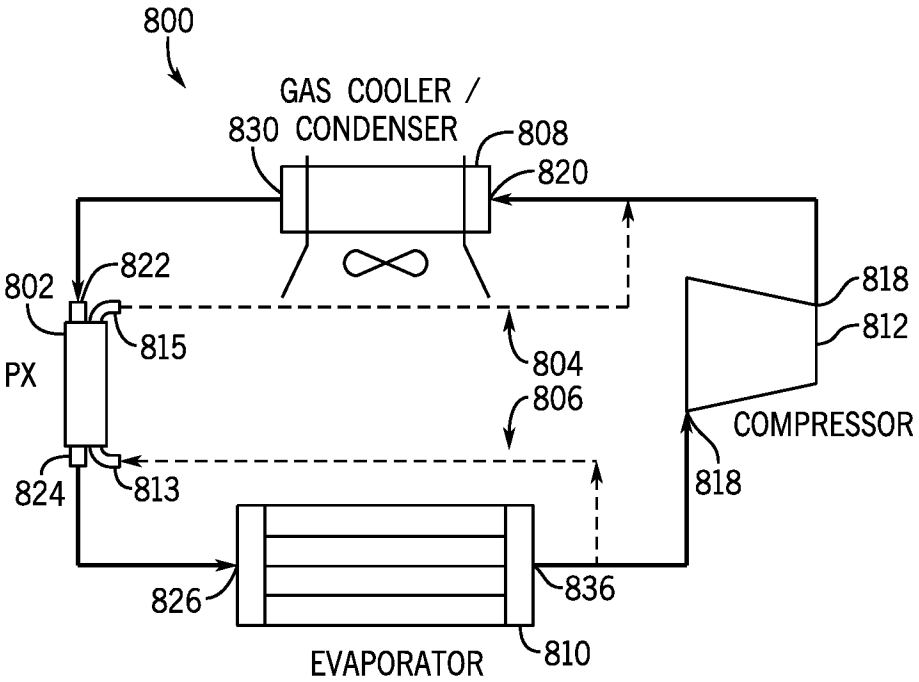
FIG. 2 is a schematic view of an embodiment of a refrigeration system with a rotary pressure exchanger or rotary liquid piston compressor (LPC)

FIG. 2 is a schematic view of an embodiment of a refrigeration system 800 (e.g., trans-critical carbon dioxide refrigeration system) that uses a fluid in a supercritical state. Although the refrigeration system 800 is described as utilizing carbon dioxide, other refrigerants may be utilized. Utilization of a rotary pressure exchanger or a rotary liquid compressor 802 (represented by PX in the figures) as described below in place of an expansion valve (e.g., Joule-Thomson valve) in the refrigeration system 800 enables the refrigeration system 800 to operate more efficiently by increasing the cooling capacity of the refrigeration system 800, while recapturing a large portion of pressure energy that would otherwise be lost utilizing the Joule-Thomson expansion valve. In certain embodiments, the rotary pressure exchanger may replace the function of the bulk flow compressor, thus, enabling the utilization of one or more low DP circulation compressors or pumps (which are significantly more energy efficient) in place of the bulk flow compressor. For example, a trans-critical carbon dioxide refrigeration system needs to operate at much larger pressure (approximately 10,342 kPa (1500 psi) or greater), which creates a large pressure ratio across the compressor (very high differential pressure compressor) that results in consuming more electrical energy. Replacing the expansion valve with the rotary pressure exchanger, enables almost all of the pressure drop to be recaptured in the rotary pressure exchanger and then utilized to pressurize the flow coming from the evaporator rather than sending the flow to the main compressor. Thus, the electricity demand of the compressor may be significantly reduced or eliminated. The refrigeration system 800 utilizing the rotary pressure exchanger in place of the Joule-Thomson expansion valve and/or the bulk flow compressor may be utilized in a variety of applications including supermarket refrigeration systems, heating, ventilation, and/or air conditioning (HVAC) systems, refrigeration for liquefied natural gas systems, industrial refrigeration for chemical processing industries, battery technology (e.g., creating a thermal energy storage system for solar or wind power using a combination of refrigeration and power cycles), aquariums, polar habitat study systems, and any other system where refrigeration is utilized.

As depicted, the refrigeration system 800 includes a first fluid loop (e.g., high pressure branch) 804 for circulating a high pressure refrigerant (e.g., carbon dioxide) and a second fluid loop (e.g., low pressure branch) 806 for circulating a low pressure refrigerant (e.g., carbon dioxide) at a lower pressure than in the high pressure branch 804. The first fluid loop 804 includes a heat exchanger 808 (e.g., gas cooler/condenser) and the rotary pressure exchanger 802. The heat exchanger 808 rejects heat to the surroundings from the high pressure refrigerant. Although a gas cooler is described below for utilization with a supercritical high pressure refrigerant (e.g., carbon dioxide), in certain embodiments, a condenser may be utilized with a subcritical high pressure refrigerant (e.g., carbon dioxide). A subcritical state for a refrigerant is below the critical point (in particular, between the critical point and the triple point). The second fluid loop 806 includes a heat exchanger 810 (e.g., cooling or thermal load such as an evaporator) and the rotary pressure exchanger 802. The heat exchanger 810 absorbs heat from the surroundings into the low pressure refrigerant. The low pressure refrigerant in the low pressure branch 806 may be in a liquid state, vapor state, or a two-phase mixture of liquid and vapor. The fluids loops 804, 806 are both fluidly coupled to a compressor 812 (e.g., bulk flow compressor). The compressor 812 converts (by increasing the temperature and the pressure) superheated gaseous carbon dioxide received from the evaporator 810 into carbon dioxide in the supercritical state that is provided to the gas cooler 808. In certain embodiments, as described in greater detail below, the compressor 812 may be replaced by one or more low DP circulation compressors or pumps to overcome small pressures losses within the system 800 and to maintain fluid flow. In general, along the first fluid loop 804, the gas cooler 808 receives and then provides carbon dioxide in the supercritical state to the rotary pressure exchanger 802 (e.g., at high pressure inlet 822) after some cooling. Along the second fluid loop 804, the evaporator 810 provides a first portion of a superheated gaseous carbon dioxide to a low pressure inlet 813 of the rotary pressure exchanger 802 and a second portion of the superheated gaseous carbon dioxide to the compressor 812. The rotary pressure exchanger 802 exchanges pressure between the carbon dioxide in the supercritical state and the superheated gaseous carbon dioxide. The carbon dioxide in the supercritical state is converted within the rotary pressure exchanger 80 to a two-phase gas/liquid mixture and exits low pressure outlet 824 where it is provided to the evaporator 810. The rotary pressure exchanger 802 also increases the pressure and the temperature of the superheated gaseous carbon dioxide to convert it to carbon dioxide in the supercritical state, which exits the rotary pressure exchanger 802 via a high pressure outlet 815 where it is provided to the gas cooler 808. As illustrated in FIG. 2, the carbon dioxide in the supercritical state exiting the rotary pressure exchanger 802 may be combined with the carbon dioxide provided to the gas cooler 808 from the compressor 812.

Figure 4:
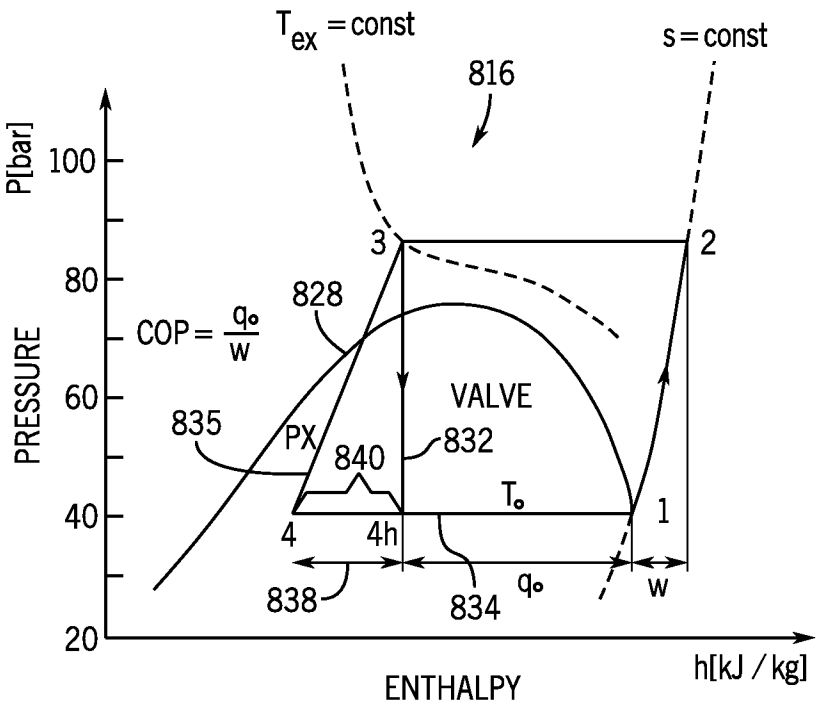
FIG. 4 is a pressure-enthalpy diagram of thermodynamic processes in a refrigeration system utilizing a Joule-Thomson expansion valve versus the refrigeration system of FIG. 2.
Figure 3:
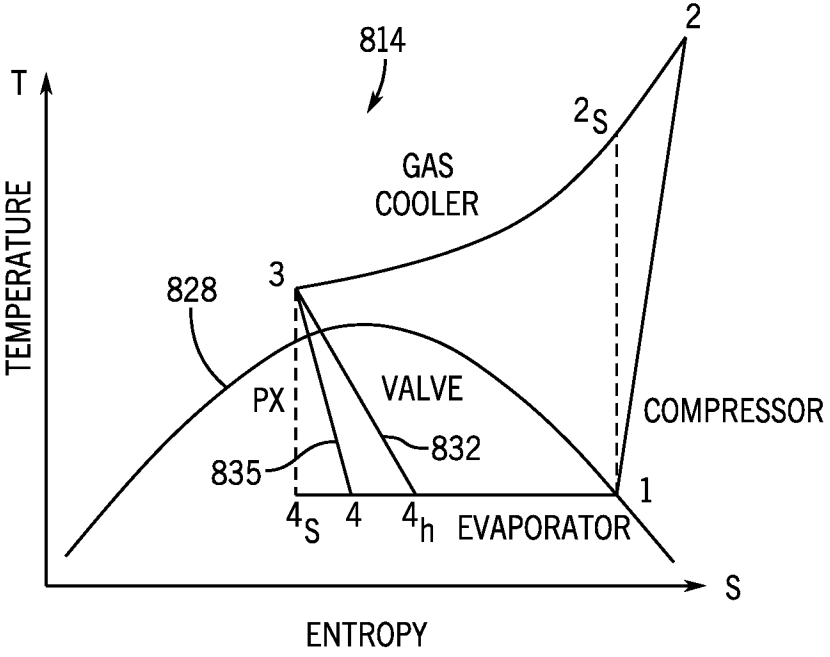
FIG. 3 is a temperature-entropy diagram showing thermodynamic processes in a refrigeration system utilizing a Joule-Thomson expansion valve versus the refrigeration system of FIG. 2.

The thermodynamic processes occurring in the refrigeration system 800 (e.g., relative to a refrigeration system that utilizes the Joule-Thomson valve) are described in greater detail with reference to FIGS. 3 and 4. FIGS. 3 and 4 illustrate a temperature-entropy (T-S) diagram 814 and pressure-enthalpy (P-H) diagram 816, respectively, to show the thermodynamic processes occurring at the four main components of the refrigeration system 800 compared to a refrigeration system that includes the Joule-Thomson expansion valve. Point 1 represents compressor inlet 818 (see FIG. 2). Point 2 represents compressor exit 820 and gas cooler inlet 820. Point 3 represents gas cooler exit 822 and expansion valve inlet (in a refrigeration system that has the Joule-Thomson expansion valve) or high pressure inlet 822 of the rotary liquid compressor 802. Point 4 represents expansion valve exit or low pressure outlet 824 of rotary liquid compressor 802 (indicated as PX in FIG. 3 and FIG. 4) and evaporator inlet 826. As illustrated in FIGS. 3 and 4, compressor 812 increases the pressure and thus the temperature of the refrigerant working fluid (e.g., carbon dioxide) to temperatures higher than the environment where it can reject heat to the outside hotter environment. This occurs inside the gas cooler 808. Unlike traditional condensers where the temperature remains constant through a large portion of the heat exchange process inside the 2 phase dome on a T-S diagram, in trans-critical carbon dioxide system's gas cooler 808, since the carbon dioxide is in supercritical state, the phase boundary does not exist and the carbon dioxide is above two-phase dome 828. Thus, the temperature drops when carbon dioxide rejects heat to the environment. The larger the environmental temperature, the larger the pressure ratio across the compressor 812 and the larger the pressure of the system. At point 3, the carbon dioxide leaving gas cooler exit 830 then goes through the expansion valve (in a refrigeration system that has the Joule-Thomson expansion valve) and follows the constant enthalpy process (3→4*h*) in the valve as shown by the curve 832. On P-H diagram 816, curve 832 is a straight vertical line (since it is isenthalpic process). As a result, carbon dioxide enters the two-phase dome 828 and becomes an equilibrium mixture of liquid and gas. The exact mass fraction of liquid is determined by the point where 4*h* (i.e., curve 832) intersects the constant pressure horizontal line 834 representing evaporator pressure. The two-phase mixture then continues through the evaporator 810, where liquid carbon dioxide absorbs more and more heat and becomes the saturated vapor at an exit 836 of the evaporator 810. Thus, the fluid going into compressor 818 is in pure vapor (gas) phase.

Now consider the system with the rotary pressure exchanger 802 replacing the Joule-Thomson valve as shown in FIG. 2. As illustrated in FIGS. 3 and 4, the carbon dioxide in supercritical state at gas cooler exit 830 enters the rotary pressure exchanger 802 at high pressure inlet port 822 and undergoes an isentropic or close to isentropic (e.g., 85 percent isentropic efficiency) expansion and exits at low pressure outlet port 824 of the rotary pressure exchanger 802 as a two-phase gas-liquid carbon dioxide mixture. This process is shown by curve 835 on T-S and P-H diagrams 814, 816. As illustrated, the curve 835 (obtained with the rotary pressure exchanger 802) lies towards the left of the curve 832 (obtained with the expansion valve), meaning the amount or percentage of liquid content in the two phase fluid is greater in the case of expansion through the rotary pressure exchanger 802 (position of point 4 on the P-H diagram 816) than that with the expansion valve (position of point 4*h* on the P-H diagram 816). Due to the greater liquid content, the heat absorption capacity of the refrigerant (e.g., carbon dioxide) is greater in the evaporator 810. Thus, for the same pressure and temperature boundary conditions set by the environmental conditions, the cooling capacity of the refrigeration system 800 is increased when the rotary pressure exchanger 802 is used instead of the Joule-Thomson valve. Position of point $\mathbf{4}_s$ on the P-H diagram 816 represents a perfect isentropic expansion process (e.g., 100 percent isentropic expansion efficiency). The two-phase carbon dioxide at point 4 then proceeds to absorb heat in the evaporator 810 (process 4→1). A length 838 of the segment 840 (defined by $\mathbf{4}_h$ minus 4) is the additional cooling capacity provided by system 800 that uses the rotary pressure exchanger 802 compared to the typical one that uses the Joule-Thomson expansion valve (length of segment 834, which is difference between enthalpy at point 1 and that at point 4*h*). This is one of the key advantages provided by integrating the rotary pressure exchanger 802 in a refrigeration cycle.

Another advantage provided by utilizing the rotary pressure exchanger 802 in a refrigeration cycle becomes apparent when looking at the second fluid stream that enters the rotary pressure exchanger 802 (at low pressure inlet 813) from the evaporator 80 as a superheated gaseous carbon dioxide and undergoes isentropic or close to isentropic (e.g., 85 percent isentropic efficiency) compression as shown by dashed line 842 (i.e., process $\mathbf{1}\rightarrow\mathbf{2}_s$). This process will be similar to isentropic process 1→2 happening inside the compressor 812. Since almost all of the compression happens inside the rotary pressure exchanger 802, in certain embodiments, the main compressor 812 may be completely or partially eliminated. For example, the compressor 812 in this case can be replaced by a very low differential pressure gas blower or a circulation pump which consumes very little work (due to very little enthalpy change across it). This produces a massive advantage to the efficiency of the refrigeration cycle, as seen from the equation for coefficient of performance (COP) (i.e., a stand measure of efficiency of the refrigeration cycle):

$$COP = \frac{\text{Heat Absorbed in Evaporator}}{\text{Work Done by Compressor}} = \frac{h_1 - h_4}{h_2 - h_1} \quad (1)$$

where h is the enthalpy at each of the four points on the P-H diagram 816. As seen, the denominator ($h_2$-$h_1$) in above equation representing work (w) done by the compressor 812 (i.e., electricity consumed by the compressor 812) becomes very small when the rotary pressure exchanger 802 is utilized instead of the traditional combination of the Joule-Thomson valve and the compressor 812. This can produce an extremely large increase in COP (i.e., efficiency) of the refrigeration cycle. When combined with the first advantage mentioned earlier (i.e., increased cooling capacity), where h at point 4 is lower than h point $\mathbf{4}_h$, the term ($h_1$-$h_4$) becomes larger for the rotary pressure exchanger based system, thus, further increasing the COP (i.e., efficiency) of the refrigeration cycle.

Figure 5:
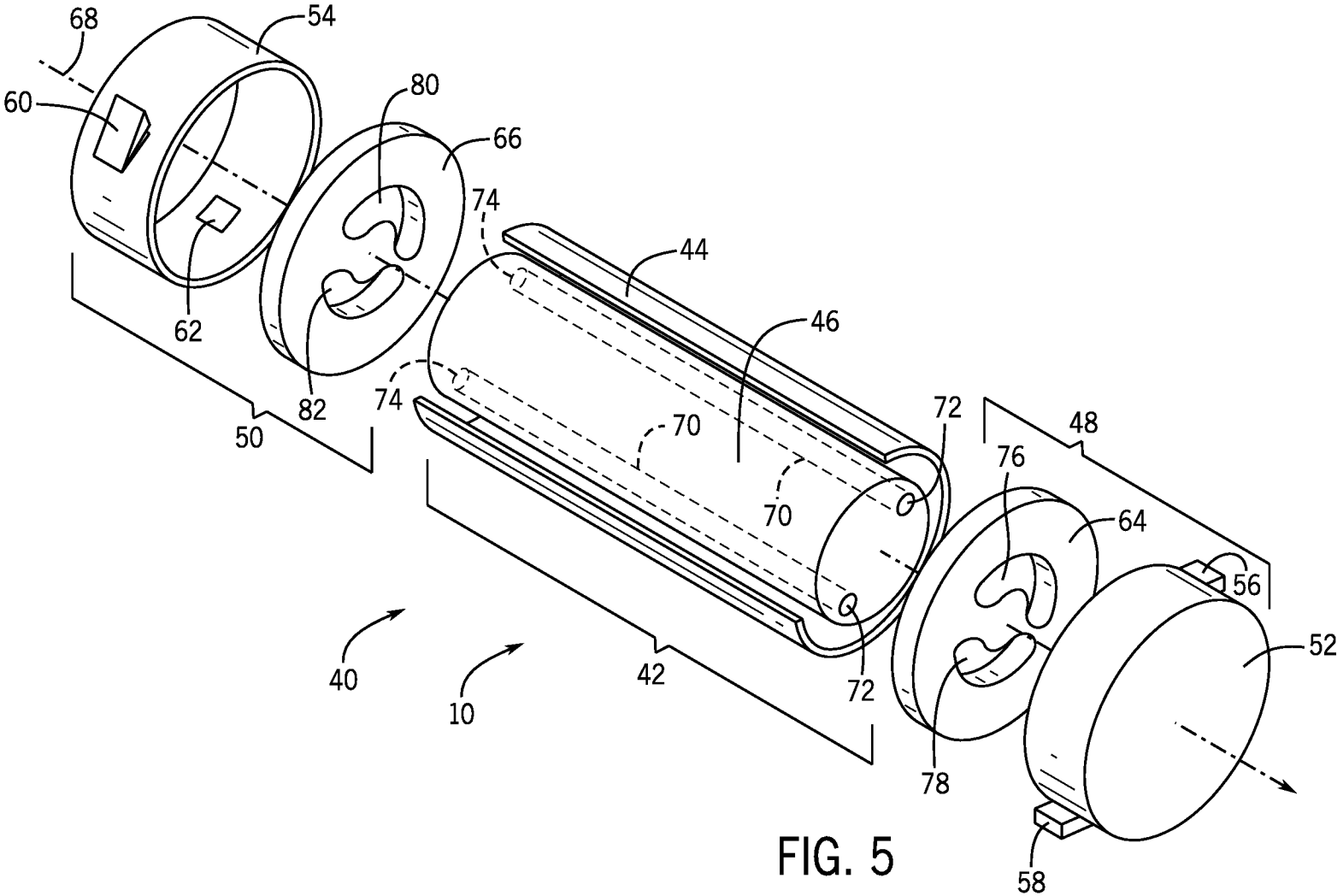
FIG. 5 is an exploded perspective view of an embodiment of a rotary pressure exchanger or a rotary LPC.

FIG. 5 is an exploded perspective view of an embodiment of a rotary pressure exchanger or a rotary liquid piston compressor 40 (rotary LPC) (e.g., rotary pressure exchanger 802 in FIG. 2) capable of transferring pressure and/or work between a first fluid (e.g., supercritical carbon dioxide circulating in the first fluid loop 804) and a second fluid (e.g., superheated gaseous carbon dioxide circulating in the second fluid loop 806) with minimal mixing of the fluids. The rotary LPC 40 may include a generally cylindrical body portion 42 that includes a sleeve 44 (e.g., rotor sleeve) and a rotor 46. The rotary LPC 40 may also include two end caps 48 and 50 that include manifolds 52 and 54, respectively. Manifold 52 includes respective inlet and outlet ports 56 and 58, while manifold 54 includes respective inlet and outlet ports 60 and 62. In operation, these inlet ports 56, 60 enabling the first and second fluids to enter the rotary LPC 40 to exchange pressure, while the outlet ports 58, 62 enable the first and second fluids to then exit the rotary LPC 40. In operation, the inlet port 56 may receive a high-pressure first fluid, and after exchanging pressure, the outlet port 58 may be used to route a low-pressure first fluid out of the rotary LPC 40. Similarly, the inlet port 60 may receive a low-pressure second fluid and the outlet port 62 may be used to route a high-pressure second fluid out of the rotary LPC 40. The end caps 48 and 50 include respective end covers 64 and 66 disposed within respective manifolds 52 and 54 that enable fluid sealing contact with the rotor 46. The rotor 46 may be cylindrical and disposed in the sleeve 44, which enables the rotor 46 to rotate about the axis 68. The rotor 46 may have a plurality of channels 70 extending substantially longitudinally through the rotor 46 with openings 72 and 74 at each end arranged symmetrically about the longitudinal axis 68. The openings 72 and 74 of the rotor 46 are arranged for hydraulic communication with inlet and outlet apertures 76 and 78; and 80 and 82 in the end covers 64 and 66, in such a manner that during rotation the channels 70 are exposed to fluid at high-pressure and fluid at low-pressure. As illustrated, the inlet and outlet apertures 76 and 78; and 80 and 82 may be designed in the form of arcs or segments of a circle (e.g., C-shaped).

In some embodiments, a controller using sensor feedback (e.g. revolutions per minute measured through a tachometer or optical encoder or volume flow rate measured through flowmeter) may control the extent of mixing between the first and second fluids in the rotary LPC 40, which may be used to improve the operability of the fluid handling system. For example, varying the volume flow rates of the first and second fluids entering the rotary LPC 40 allows the plant operator (e.g., system operator) to control the amount of fluid mixing within the rotary liquid piston compressor 10. In addition, varying the rotational speed of the rotor 46 also allows the operator to control mixing. Three characteristics of the rotary LPC 40 that affect mixing are: (1) the aspect ratio of the rotor channels 70, (2) the duration of exposure between the first and second fluids, and (3) the creation of a fluid barrier (e.g., an interface) between the first and second fluids within the rotor channels 70. First, the rotor channels 70 are generally long and narrow, which stabilizes the flow within the rotary LPC 40. In addition, the first and second fluids may move through the channels 70 in a plug flow regime with minimal axial mixing. Second, in certain embodiments, the speed of the rotor 46 reduces contact between the first and second fluids. For example, the speed of the rotor 46 may reduce contact times between the first and second fluids to less than approximately 0.15 seconds, 0.10 seconds, or 0.05 seconds. Third, a small portion of the rotor channel 70 is used for the exchange of pressure between the first and second fluids. Therefore, a volume of fluid remains in the channel 70 as a barrier between the first and second fluids. All these mechanisms may limit mixing within the rotary LPC 40. Moreover, in some embodiments, the rotary LPC 40 may be designed to operate with internal pistons or other barriers, either complete or partial, that isolate the first and second fluids while enabling pressure transfer.

FIGS. 6-9 are exploded views of an embodiment of the rotary LPC 40 illustrating the sequence of positions of a single rotor channel 70 in the rotor 46 as the channel 70 rotates through a complete cycle. It is noted that FIGS. 6-9 are simplifications of the rotary LPC 40 showing one rotor channel 70, and the channel 70 is shown as having a circular cross-sectional shape. In other embodiments, the rotary LPC 40 may include a plurality of channels 70 with the same or different cross-sectional shapes (e.g., circular, oval, square, rectangular, polygonal, etc.). Thus, FIGS. 6-9 are simplifications for purposes of illustration, and other embodiments of the rotary LPC 40 may have configurations different from that shown in FIGS. 6-9. As described in detail below, the rotary LPC 40 facilitates pressure exchange between first and second fluids by enabling the first and second fluids to briefly contact each other within the rotor 46. In certain embodiments, this exchange happens at speeds that result in limited mixing of the first and second fluids. More specifically, the speed of the pressure wave traveling through the rotor channel 70 (as soon as the channel is exposed to the aperture 76), the diffusion speeds of the fluids, and the rotational speed of rotor 46 dictate whether any mixing occurs and to what extent.

Figures 6, 7, 8, 9:
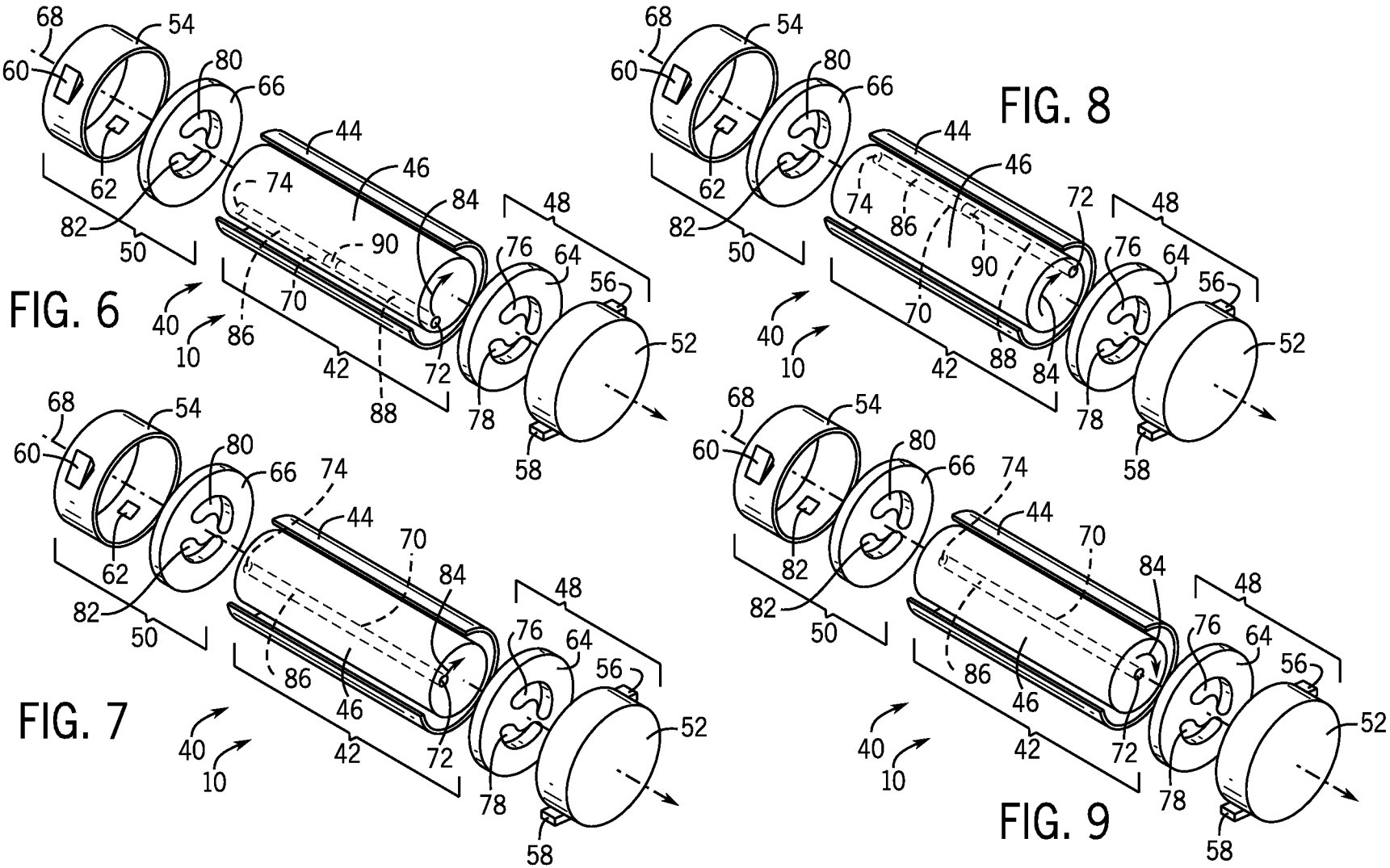
FIG. 6 is an exploded perspective view of an embodiment of a rotary pressure exchanger or a rotary LPC in a first operating position.
FIG. 7 is an exploded perspective view of an embodiment of a rotary pressure exchanger or a rotary LPC in a second operating position.
FIG. 8 is an exploded perspective view of an embodiment of a rotary pressure exchanger or a rotary LPC in a third operating position.
FIG. 9 is an exploded perspective view of an embodiment of a rotary pressure exchanger or a rotary LPC in a fourth operating position.

In FIG. 6, the channel opening 72 is in a first position. In the first position, the channel opening 72 is in fluid communication with the aperture 78 in end cover 64 and therefore with the manifold 52, while the opposing channel opening 74 is in hydraulic communication with the aperture 82 in end cover 66 and by extension with the manifold 54. As will be discussed below, the rotor 46 may rotate in the clockwise direction indicated by arrow 84. In operation, low-pressure second fluid 86 passes through end cover 66 and enters the channel 70, where it contacts the first fluid 88 at a dynamic fluid interface 90. The second fluid 86 then drives the first fluid 88 out of the channel 70, through end cover 64, and out of the rotary LPC 40. However, because of the short duration of contact, there is minimal mixing between the second fluid 86 and the first fluid 88.

In FIG. 7, the channel 70 has rotated clockwise through an arc of approximately 90 degrees. In this position, the opening 74 (e.g. outlet) is no longer in fluid communication with the apertures 80 and 82 of end cover 66, and the opening 72 is no longer in fluid communication with the apertures 76 and 78 of end cover 64. Accordingly, the low-pressure second fluid 86 is temporarily contained within the channel 70.

In FIG. 8, the channel 70 has rotated through approximately 60 degrees of arc from the position shown in FIG. 7. The opening 74 is now in fluid communication with aperture 80 in end cover 66, and the opening 72 of the channel 70 is now in fluid communication with aperture 76 of the end cover 64. In this position, high-pressure first fluid 88 enters and pressurizes the low-pressure second fluid 86 driving the second fluid 86 out of the rotor channel 70 and through the aperture 80.

In FIG. 9, the channel 70 has rotated through approximately 270 degrees of arc from the position shown in FIG. 6. In this position, the opening 74 is no longer in fluid communication with the apertures 80 and 82 of end cover 66, and the opening 72 is no longer in fluid communication with the apertures 76 and 78 of end cover 64. Accordingly, the first fluid 88 is no longer pressurized and is temporarily contained within the channel 70 until the rotor 46 rotates another 90 degrees, starting the cycle over again.

Figure 10:
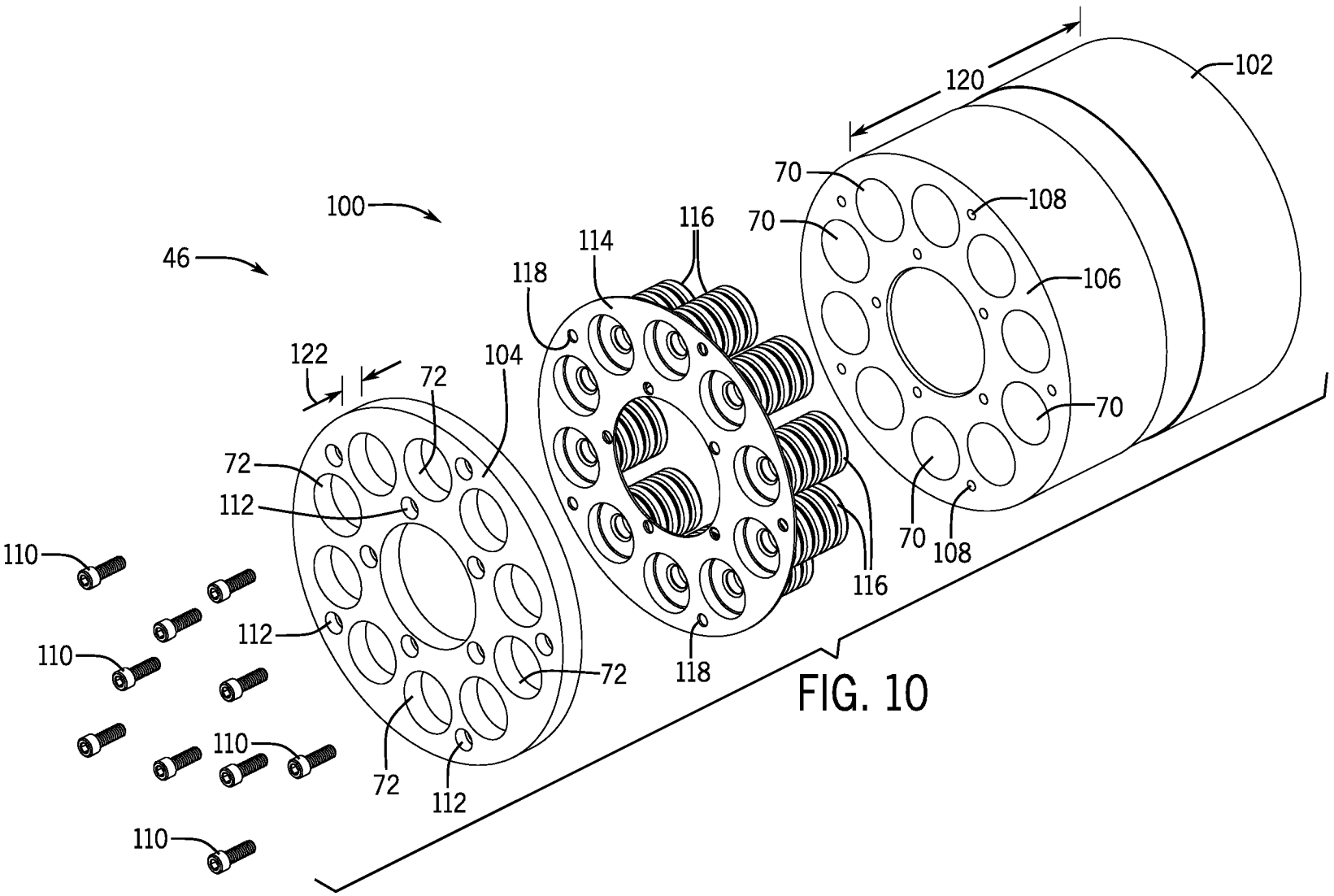
FIG. 10 is an exploded view of an embodiment of a rotor with a barrier system.

FIG. 10 is an exploded view of an embodiment of a rotor 46 with a barrier system 100. As explained above, rotation of the rotor 46 enables pressure transfer between first and second fluids. In order to block mixing between the first fluid/motive fluid and the second fluid/supercritical fluid in the power generation system 4, the rotary liquid piston compressor 10 includes the barrier system 100. As illustrated, the rotor 46 includes a first rotor section 102 and a second rotor section 104 that couple together. By including a rotor 46 with first and second rotor sections 102, 104 the rotor 46 is able to receive and hold the barrier system 100 within rotor 46. As illustrated, the first rotor section 102 includes an end face 106 with apertures 108 that receive bolts 110. The bolts 110 pass through these apertures 108 and enter apertures 112 in the second rotor section 104 to couple the first and second sections 102, 104 of the rotor 46. The barrier system 100 is placed between these rotor sections 102, 104 enabling the rotor 46 to secure the barrier system 100 to the rotor 46.

The barrier system 100 may include a plate 114 with a plurality of barriers 116 coupled to the plate 114. These barriers 116 are foldable diaphragms that block contact/mixing between the first and second fluids as they exchange pressure in the channel 70 of the rotor 46. As will be discussed below, these barriers 116 expand and contract as pressure is transferred between the first and second fluids. In order to couple the plate 114 to the rotor 46, the plate 114 may include a plurality of apertures 118 that align with the apertures 108 in the first rotor section 102 and the apertures 112 in the second rotor section 104. These apertures 118 receive the bolts 110 when the first rotor section 102 couples to the second rotor section 104 reducing or blocking lateral movement of the plate 114. In some embodiments, the apertures 108 on the first rotor section 102, the apertures 112 on the second rotor section 104, and the apertures 118 on the plate 114 may be placed on one or more diameters (e.g., an inner diameter and an outer diameter). In this way, the first rotor section 102 and the second rotor section 104 may evenly compress the plate 114 when coupled. In some embodiments, the barriers 116 may not couple to or be supported by the plate 114. Instead, each barrier 116 may couple individually to the rotor 46.

As illustrated, the first rotor section 102 defines a length 120 and the second rotor section 104 defines a length 122. By changing the length 120 and 122, the rotor 46 enables the barrier system 100 to be placed at different positions in the channels 70 along the length of the rotor 46. In this way, the rotary liquid piston compressor 10 may be adapted in response to various operating conditions. For example, differences in density and mass flow rates of the two fluids and the rotational speed of the rotor 46 among others may affect how far the first and second fluids are able to flow into the channels 70 of the rotor 46 to exchange pressure. Accordingly, changing the lengths 120 and 122 of the first and second rotor sections 102 and 104 of the rotor 46 enables placement of the barrier system 100 in a position that facilitates the pressure exchange between the first and second fluids (e.g., halfway through the rotor 46).

In some embodiments, the refrigeration system 800 may modify the fluids circulating in the first and second loops 804 and 806 to resist mixing in the rotary liquid piston compressor 802. For example, the refrigeration system 800 may use an ionic fluid in the first loop 804 that may prevent diffusion and solubility of the supercritical fluid with another fluid in a different phase, or in other words may resist mixing with the supercritical fluid. Modifying of the fluids in the refrigeration system 800 may also be used in combination with the barrier system 100 to provide redundant resistance to mixing of fluids in the rotary liquid piston compressor 802.

Figure 11:
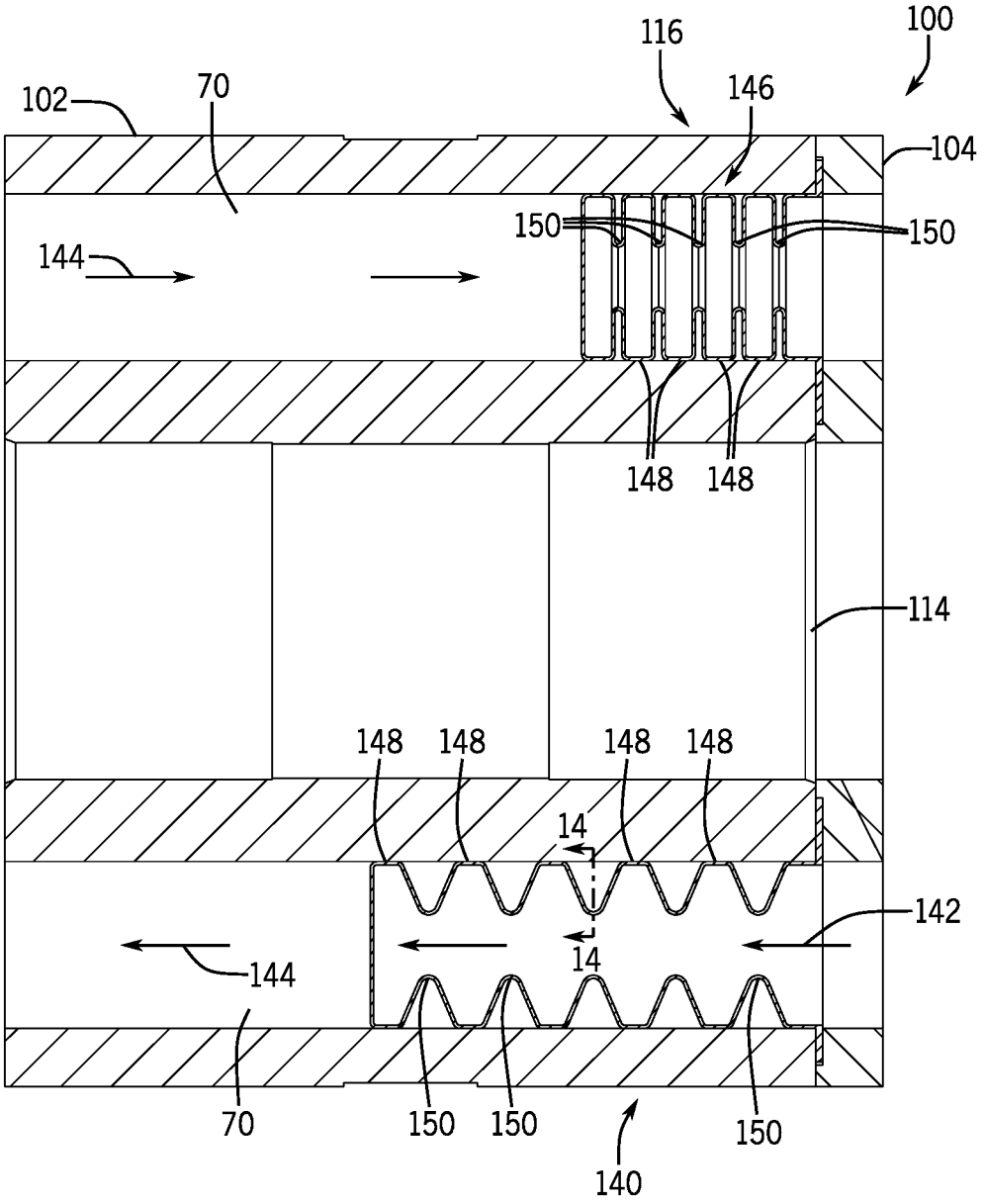
FIG. 11 is a cross-sectional view of an embodiment of a rotor with a barrier system.

FIG. 11 is a cross-sectional view of an embodiment of a rotor 46 with a barrier system 100. As explained above, the barrier system 100 may include the plate 114 and barriers 116. These barriers 116 rest within the channels 70 and block mixing/contact between the first and second fluids while still enabling pressure transfer. In order to facilitate pressure transfer, the barriers 116 expand and contract. As illustrated in FIG. 11, a first barrier 140 of the plurality of barriers 116 is in an expanded position. In operation, the first barrier 140 expands as the first fluid 142 flows into the rotor 46 and into the first barrier 140. As the first barrier 140 expands, it pressurizes the second fluid 144 driving it out of the rotor 46. Simultaneously, a second barrier 146 may be in a contracted state as the second fluid 144 enters the rotor 46 in preparation for being pressurized. The barriers 116 include a plurality of folds 148 (e.g., 1, 2, 3, 4, 5, or more) that couple together with ribs 150. It is these elastic folds 148 that enable the barriers 116 to expand in volume as the pressurized first fluid 142 flows into the rotor 46. As will be discussed below, the barriers 116 may be made of one or more materials that provide the tensile strength, elongation percentage, and chemical resistance to work with a supercritical fluid (e.g., carbon dioxide).

Figure 12:
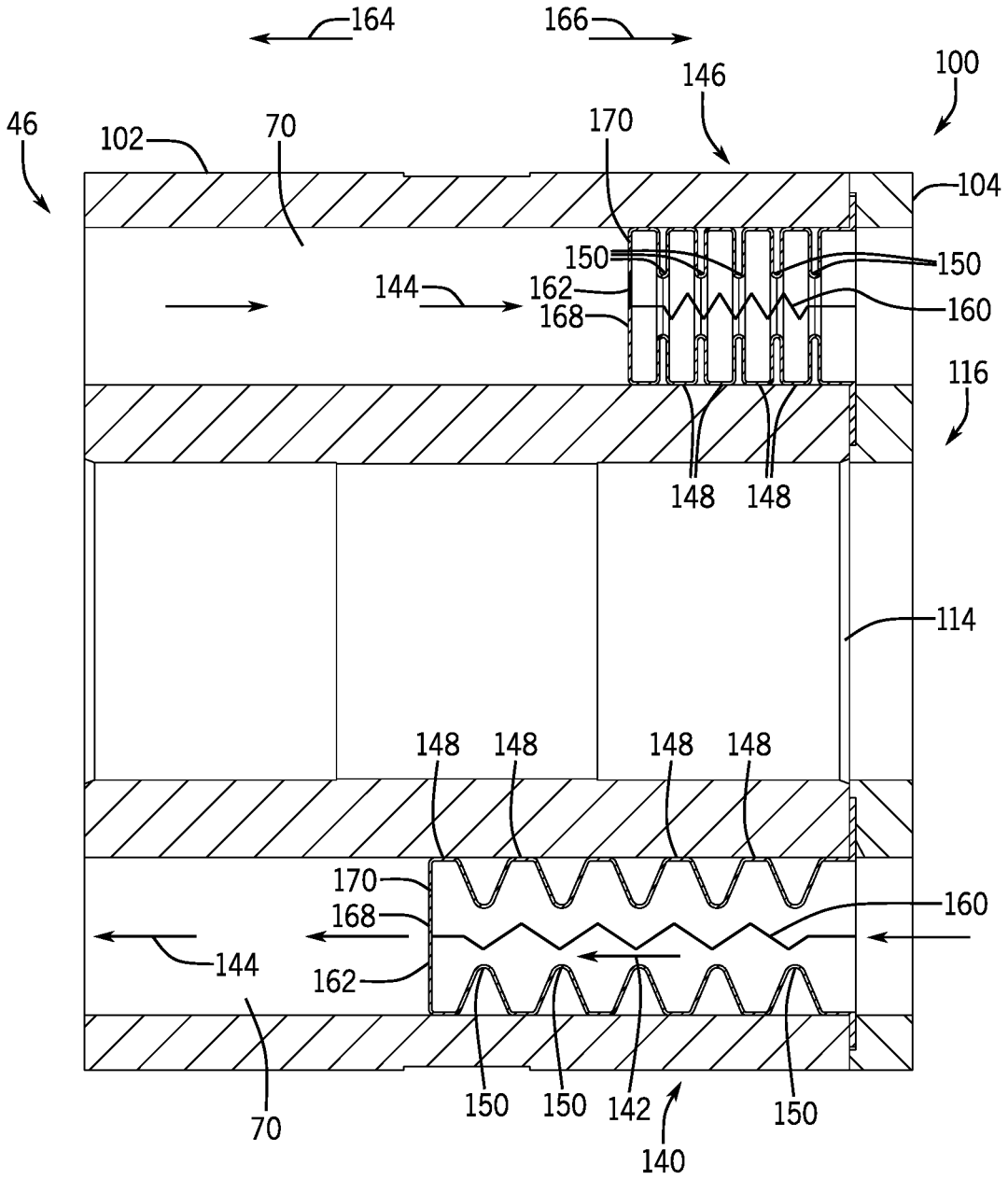
FIG. 12 is a cross-sectional view of an embodiment of a rotor with a barrier system.

FIG. 12 is a cross-sectional view of an embodiment of a rotor 46 with a barrier system 100. As illustrated in FIG. 12, a first barrier 140 of the plurality of barriers 116 is in an expanded position. In operation, the first barrier 140 expands as the first fluid 142 flows into the rotor 46 and into the first barrier 140. As the first barrier 140 expands the first barrier 140 contacts and pressurizes the second fluid 144 driving it out of the rotor 46. To reduce the stress in the barriers 116, the barrier system 100 may include springs 160. The springs 160 may couple to an end 162 (e.g., end portion, end face) of the barrier 116 and to the plate 114. In operation, the springs 160 stretch as pressure in the barriers 116 increases and the barriers 116 expand in axial direction 164. Because the springs 160 absorb force as the barrier 116 expands, the springs 160 may block or reduce overexpansion of the barriers 116. The springs 160 may also increase the longevity of the barriers 116 as the barriers 116 repeatedly expand and contract during operation of power generation system 4. The springs may also provide a more controlled rate of expansion of the barriers 116.

In some embodiments, the springs 160 may couple to an exterior surface 168 of the barriers 116 and/or be placed outside of the barriers 116. In other embodiments, the springs 160 may couple to an interior surface 170 and/or be placed within the barriers 116 (i.e., within the membrane of the barriers 116). In still other embodiments, the barrier system 100 may include springs 160 both outside of and inside the barriers 116. The springs 160 may also couple to the rotor 46 instead of coupling to the plate 114. For example, springs 160 may be supported by sandwiching a portion of the springs 160 between the first rotor section 102 and the second rotor section 104 of the rotor 46.

Figure 13:
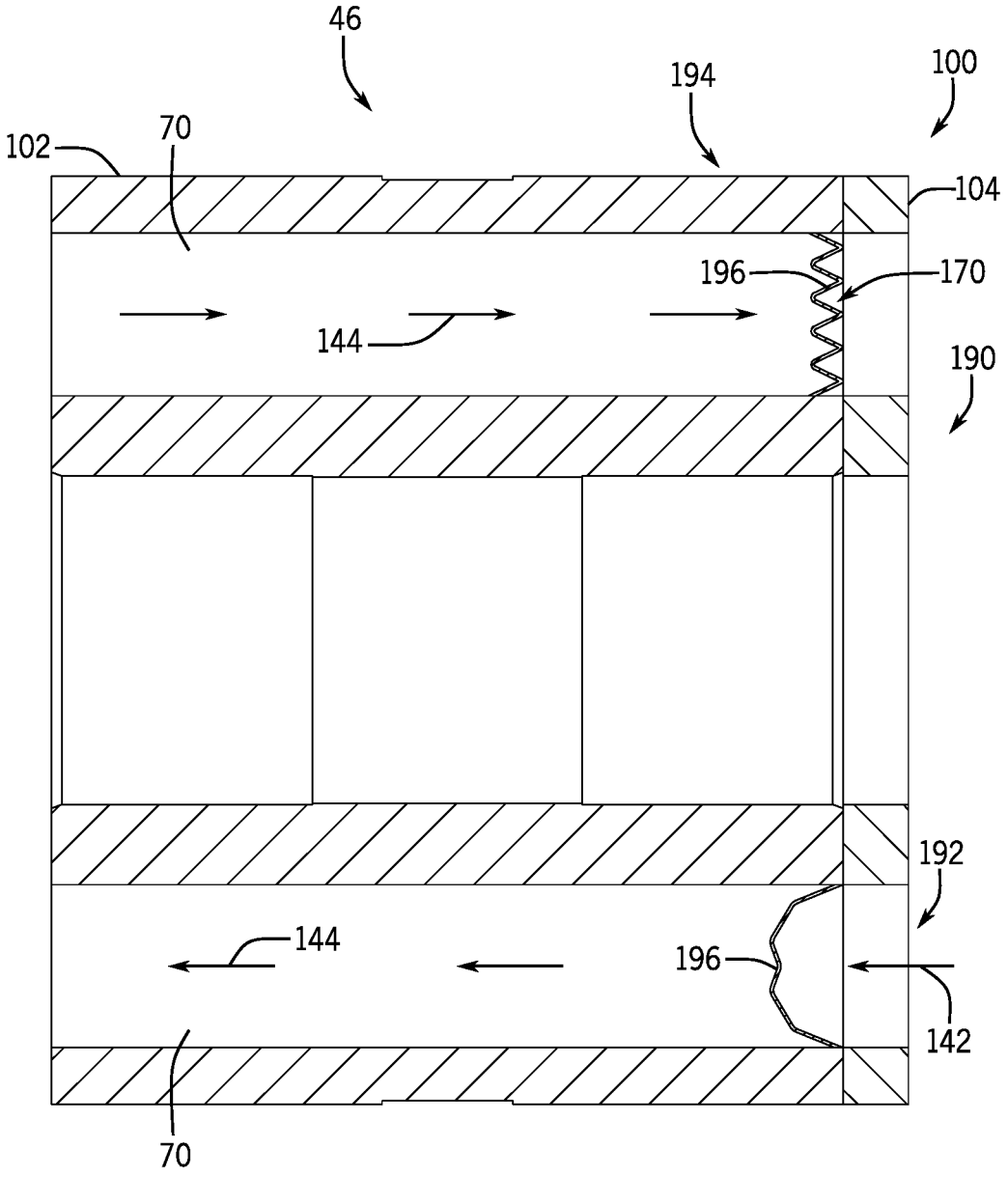
FIG. 13 is a cross-sectional view of an embodiment of a rotor with a barrier system.

FIG. 13 is a cross-sectional view of an embodiment of a rotor 46 with a barrier system 100. In FIG. 13, the barrier system 100 includes plane barriers 190. As illustrated, the plane barriers 190 extend across the channels 70 (e.g., in a generally crosswise direction to the longitudinal axis of the channel 70) instead of axially into the channels 70 as the barriers 116 described above. In operation, the plane barriers 190 block mixing/contact between the first and second fluids 142, 144 while still enabling pressure transfer. In order to facilitate pressure transfer the plane barriers 190 expand and contract under pressure. As illustrated in FIG. 13, a first plane barrier 192 of the plurality of plane barriers 190 is in an expanded position. The first plane barrier 192 expands as the first fluid 142 flow into the rotor 46 and into the first plane barrier 192. As the first plane barrier 192 expands under the pressure of the first fluid 142, the first plane barrier 192 contacts and pressurizes the second fluid 144 driving it out of the rotor 46. A second plane barrier 194 may also be simultaneously contracting as the second fluid 144 enters the rotor 46 in preparation for being pressurized. The barriers 116 include a plurality of folds 196 (e.g., 1, 2, 3, 4, 5, or more) that couple. It is these elastic folds 148 that expand as the pressurized first fluid 142 flows into the rotor 46 and contract when pressure is released.

Figure 14:
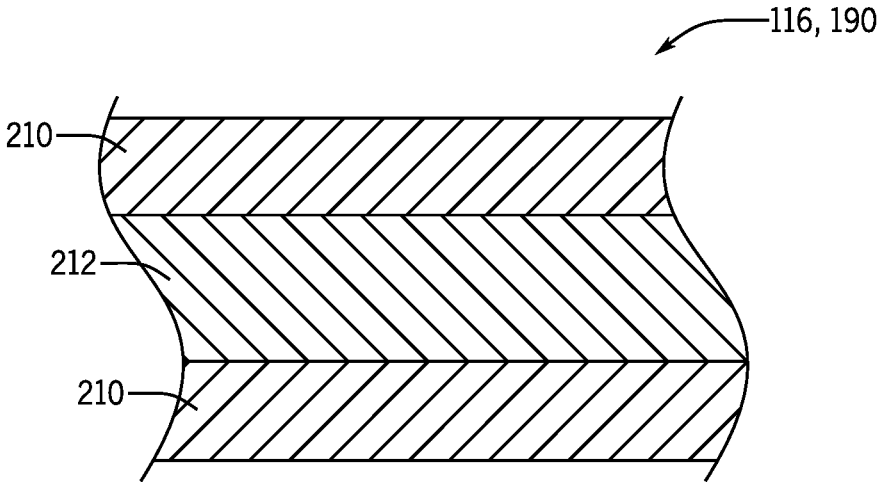
FIG. 14 is a cross-sectional view of an embodiment of a barrier along line 14-14 of FIG. 11.

FIG. 14 is a cross-sectional view of an embodiment of a barrier along line 14-14 of FIG. 11. The barriers 116 as well as the barriers 190 may be made of one or more materials that provide the tensile strength, elongation percentage, and chemical resistance to work with a supercritical fluid (e.g., carbon dioxide). For example, the barriers 116, 190 may include high stretch ratio elastomeric materials like ethylene propylene, silicone, nitrile, neoprene etc. The high stretch ratio capability of these materials enables the barriers 116, 119 to absorb the pressure from the first fluid 142 and transfer it to the second fluid 144. In some embodiments, the barriers 116, 119 may include multiple layers (e.g., 1, 2, 3, 4, 5, or more layers) of high stretch ratio materials sandwiched between layers of high strength fabric in order to combine high stretch ratio properties with high strength properties. For example, the barriers 116, 119 may include two elastomer layers 210 that overlap a fabric layer 212. In operation, the elastomer layers 210 may provide chemical resistance as well as high stretch ratio capacity, while the fabric layer 212 may increase overall tensile strength of the barrier 116, 190.

Figure 15:
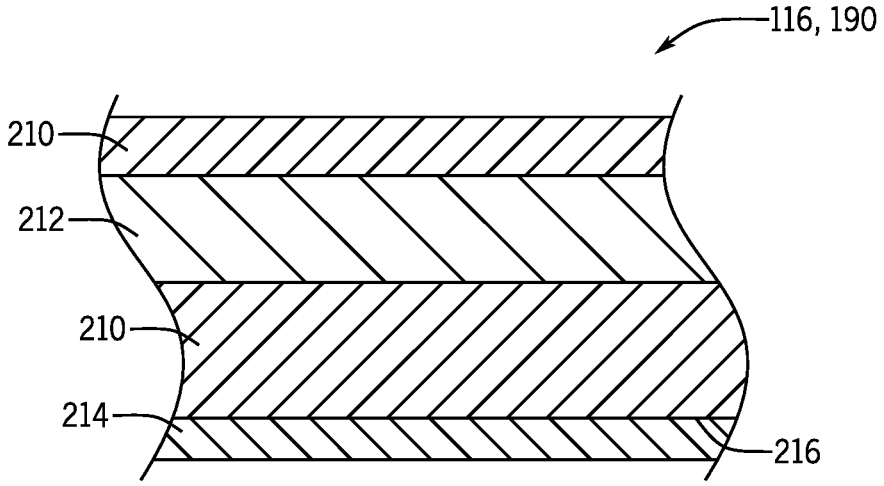
FIG. 15 is a cross-sectional view of an embodiment of a barrier along line 14-14 of FIG. 11.

FIG. 15 is a cross-sectional view of an embodiment of a barrier along line 14-14 of FIG. 11. As explained above, the barriers 116, 190 may be made of one or more materials that provide the tensile strength, elongation percentage, and chemical resistance to work with a supercritical fluid (e.g., temperature and pressures of a supercritical fluid). In some embodiments, the barriers 116, 119 may include multiple layers in order to combine properties of different materials (e.g., 1, 2, 3, 4, 5, or more layers). For example, the barriers 116, 119 may include two elastomer layers 210 (e.g., ethylene propylene, silicone, nitrile, neoprene etc.) that overlap a fabric layer 212). In operation, the elastomer layers 210 may provide chemical resistance as well as high stretch ratio capacity, while the fabric layer 212 increases tensile strength of the barrier 116, 190. Furthermore, one or more of the layers 210 may include a coating 214. The coating 214 may be a chemically resistant coating that resists reacting with the first fluid and/or the second fluid. For example, a layer 210 may include the coating 214 on an outermost surface 216 that chemically protects the layer 210 from the supercritical fluid.

Figure 16:
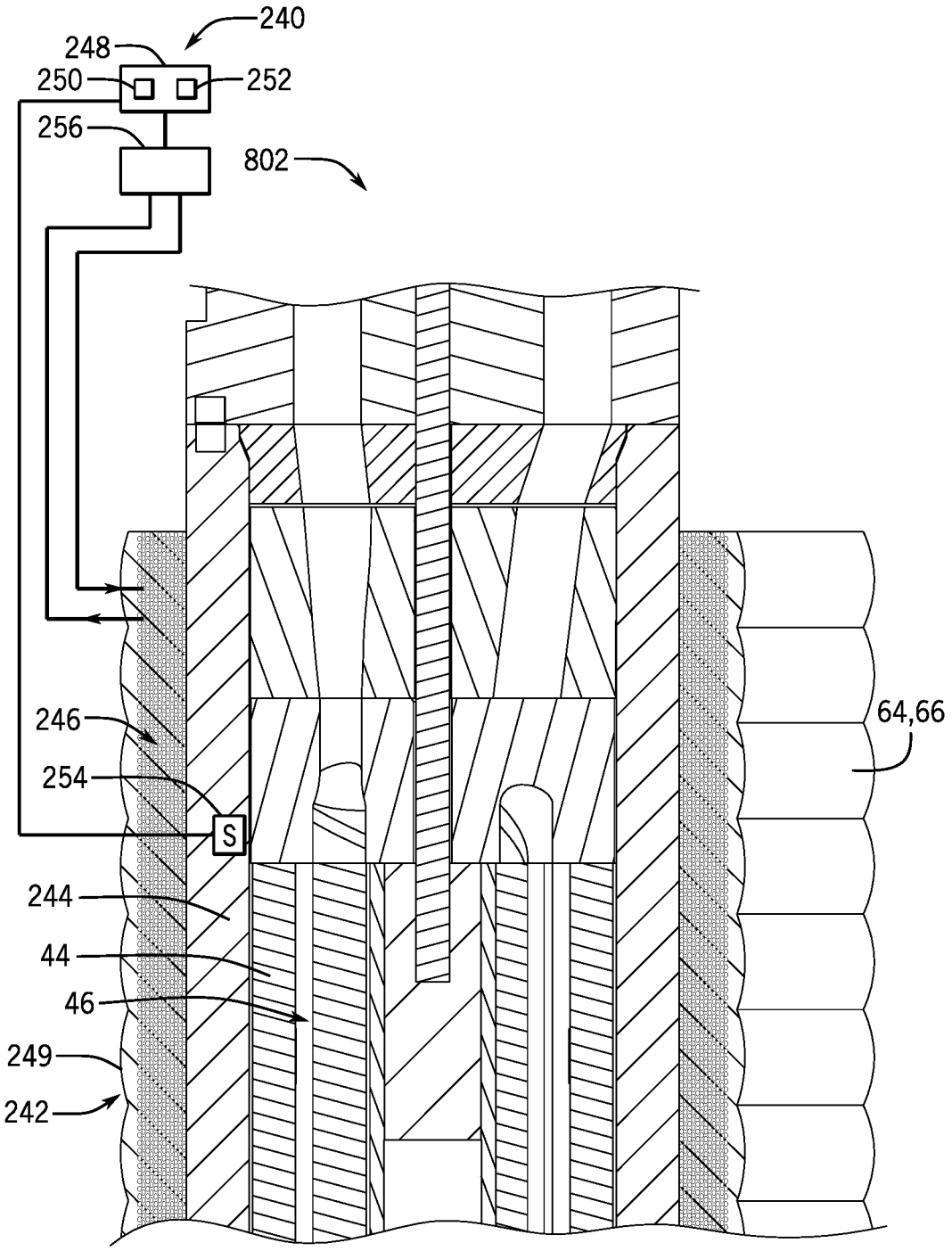
FIG. 16 is a cross-sectional view of an embodiment of a rotary pressure exchanger or a rotary liquid piston compressor with a cooling system.

FIG. 16 is a cross-sectional view of an embodiment of a rotary liquid piston compressor 10 (e.g., rotary LPC) with a cooling system 240 (i.e., thermal management system). In some embodiments, the cooling system 240 may include a micro-channel fabricated heat exchanger that surrounds the rotary liquid piston compressor. As explained above in the description of FIG. 1, fluids change phases as temperatures and pressures change. At a pressure and temperature greater than the critical point, the fluid becomes a supercritical fluid. The refrigeration system 800 uses a fluid (e.g., carbon dioxide) in its supercritical state/phase for refrigeration because of the unique properties of supercritical fluids (i.e., liquid-like densities and gas-like viscosities). By controlling the temperature in the rotary liquid piston compressor 10 with the cooling system 240, the cooling system 240 may block a phase change from supercritical fluid to gas phase inside the rotary liquid piston compressor 802. In addition, the cooling system 240 may also facilitate energy removal as heat is generated during compression of supercritical fluid, thus enabling a substantially iso-thermal compression, which is a thermodynamically more efficient mode of compression. As explained above, the cooling system 240 may include micro-channels, which provide high surface area per unit volume to facilitate heat transfer coefficients between the walls of the rotary liquid piston compressor 802 and the cooling fluid circulating through the cooling system 240.

The cooling system 240 includes a cooling jacket 242 that surrounds at least a portion of the rotary liquid piston compressor housing 244. The cooling jacket 242 may include a plurality of conduits 246 that wrap around the housing 244. These conduits 246 may be micro-conduits having a diameter between 0.05 mm and 0.5 mm. By including micro-conduits, the cooling system 240 may increase the cooling surface area to control the temperature of the supercritical fluid in the rotary liquid piston compressor 10. The conduits 246 may be arranged into a plurality of rows (e.g., 1, 2, 3, 4, 5, or more) and/or a plurality of columns (e.g., 1, 2, 3, 4, 5, or more). Each conduit 246 may be fluidly coupled to every other conduit 246 or the cooling system 240 may fluidly couple to subsets of the conduits 246. For example, every conduit 246 in a row may be fluidly coupled to the other conduits 246 in the row but not to the conduits 246 in other rows. In some embodiments, each conduit 246 may fluidly couple to the other conduits 246 in the same column, but not to conduits 246 in different columns. In some embodiments, the conduits 246 may be enclosed by a housing or covering 247. The housing or covering 247 may made from a material that insulates and resists heat transfer, such as polystyrene, fiberglass wool or various types of foams. The flow of cooling fluid through the conduits 246 may be controlled by a controller 248. The controller 248 may include a processor 250 and a memory 252. For example, the processor 250 may be a microprocessor that executes software to control the operation of the actuators 98. The processor 250 may include multiple microprocessors, one or more "general-purpose" microprocessors, one or more special-purpose microprocessors, and/or one or more application specific integrated circuits (ASICS), or some combination thereof. For example, the processor 250 may include one or more reduced instruction set (RISC) processors.

The memory 252 may include a volatile memory, such as random access memory (RAM), and/or a nonvolatile memory, such as read-only memory (ROM). The memory 252 may store a variety of information and may be used for various purposes. For example, the memory 252 may store processor executable instructions, such as firmware or software, for the processor 250 to execute. The memory may include ROM, flash memory, a hard drive, or any other suitable optical, magnetic, or solid-state storage medium, or a combination thereof. The memory may store data, instructions, and any other suitable data.

In operation, the controller 248 may receive feedback from one or more sensors 254 (e.g., temperature sensors, pressure sensors) that detects either directly or indirectly the temperature and/or pressure of the supercritical fluid. Using feedback from the sensors 254, the controller 248 controls the flowrate of cooling fluid from a cooling fluid source 256 (e.g., chiller system, air conditioning system).

Figure 17:
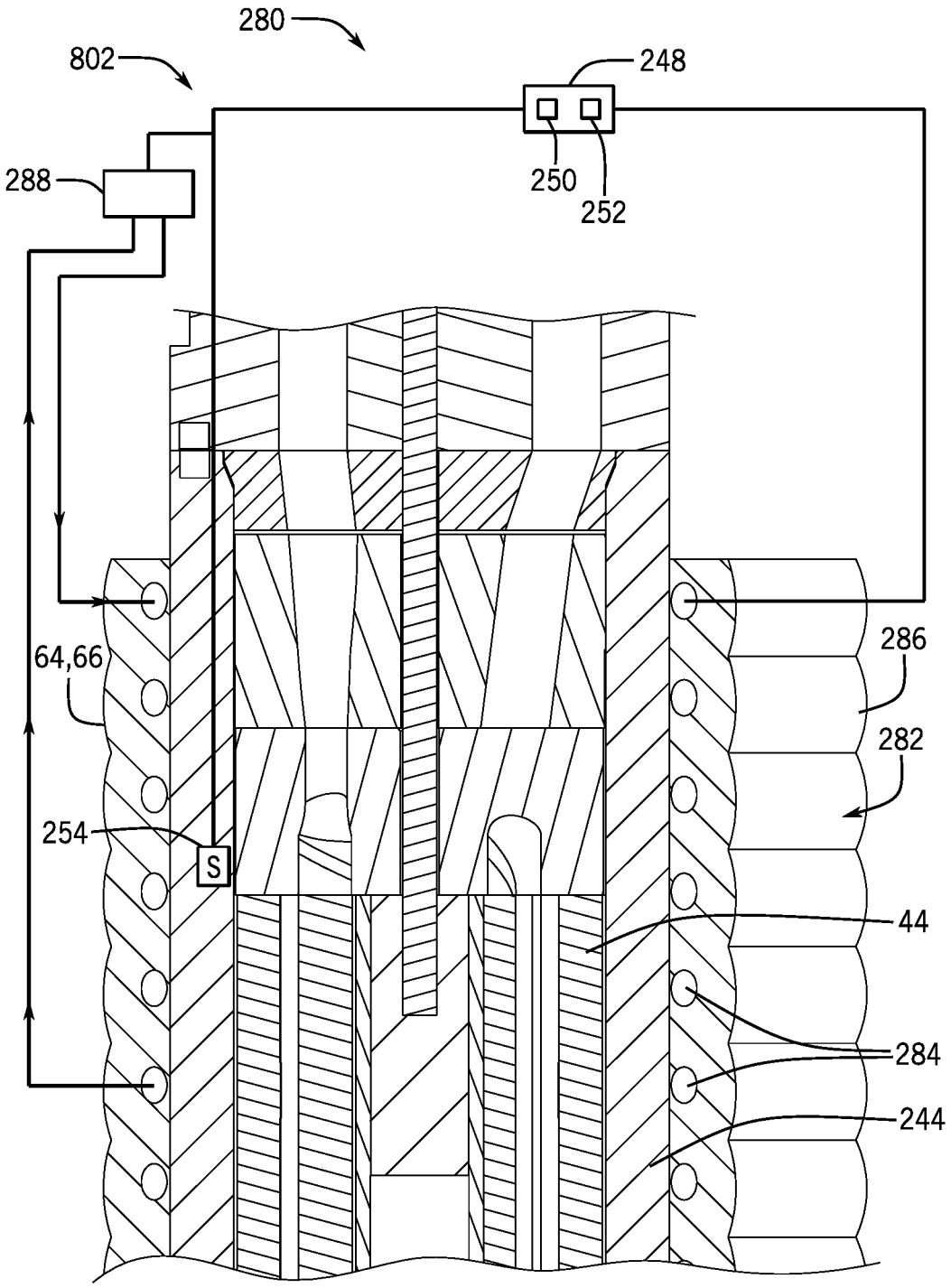
FIG. 17 is a cross-sectional view of an embodiment of a rotary pressure exchanger or a rotary liquid piston compressor with a heating system.

FIG. 17 is a cross-sectional view of an embodiment of a rotary liquid piston compressor 802 (RLPC) with a heating system 280 (i.e., thermal management system). In operation, the heating system 280 may control the temperature of the fluid (i.e., supercritical fluid) circulating through the rotary liquid piston compressor 802. By controlling the temperature, the heating system 280 may block or reduce condensation and/or dry ice formation of the fluid due to non-isentropic expansion.

The heating system 280 includes a heating jacket 282 that surrounds at least a portion of the rotary liquid piston compressor housing 244. The heating jacket 282 may include a plurality of conduits or cables 284 that wrap around the housing 244. These conduits or cables 284 enable temperature control of the supercritical fluid. For example, the conduits 284 may carry a heating fluid that transfers heat to the supercritical fluid. In some embodiments, the cable(s) 284 (e.g., coil) may carry electrical current that generates heat due to the electrical resistance of the cable(s) 284. The conduits 246 may also be enclosed by a housing or covering 286. The housing or covering 286 may be made from a material that insulates and resists heat transfer, such as polystyrene, fiberglass wool or various types of foams The flow of heating fluid or electric current through the conduits or cables 284 is controlled by the controller 248. In operation, the controller 248 may receive feedback from one or more sensors 254 (e.g., temperature sensors, pressure sensors) that detects either directly or indirectly the temperature and/or pressure of the supercritical fluid. For example, the sensors 254 may be placed in direct contact with the supercritical fluid (e.g., within a cavity containing the supercritical fluid). In some embodiments, the sensors 254 may be placed in the housing 244, sleeve 44, end covers 64, 66. As the material around the sensors 254 respond to changes in temperature and/or pressure of the supercritical fluid, the sensors 254 sense this change and communicate this change to the controller 248. The controller 248 then correlates this to a temperature and/or pressure of the actual supercritical fluid. Using feedback from the sensors 254, the controller 248 may control the flowrate of heating fluid from a heating fluid source 288 (e.g., boiler) through the conduits 284. Similarly, if the heating system 280 is an electrical resistance heating system, the controller 248 may control the flow of current through the cable(s) 284 in response to feedback from one or more of the sensors 254.

Figure 18:
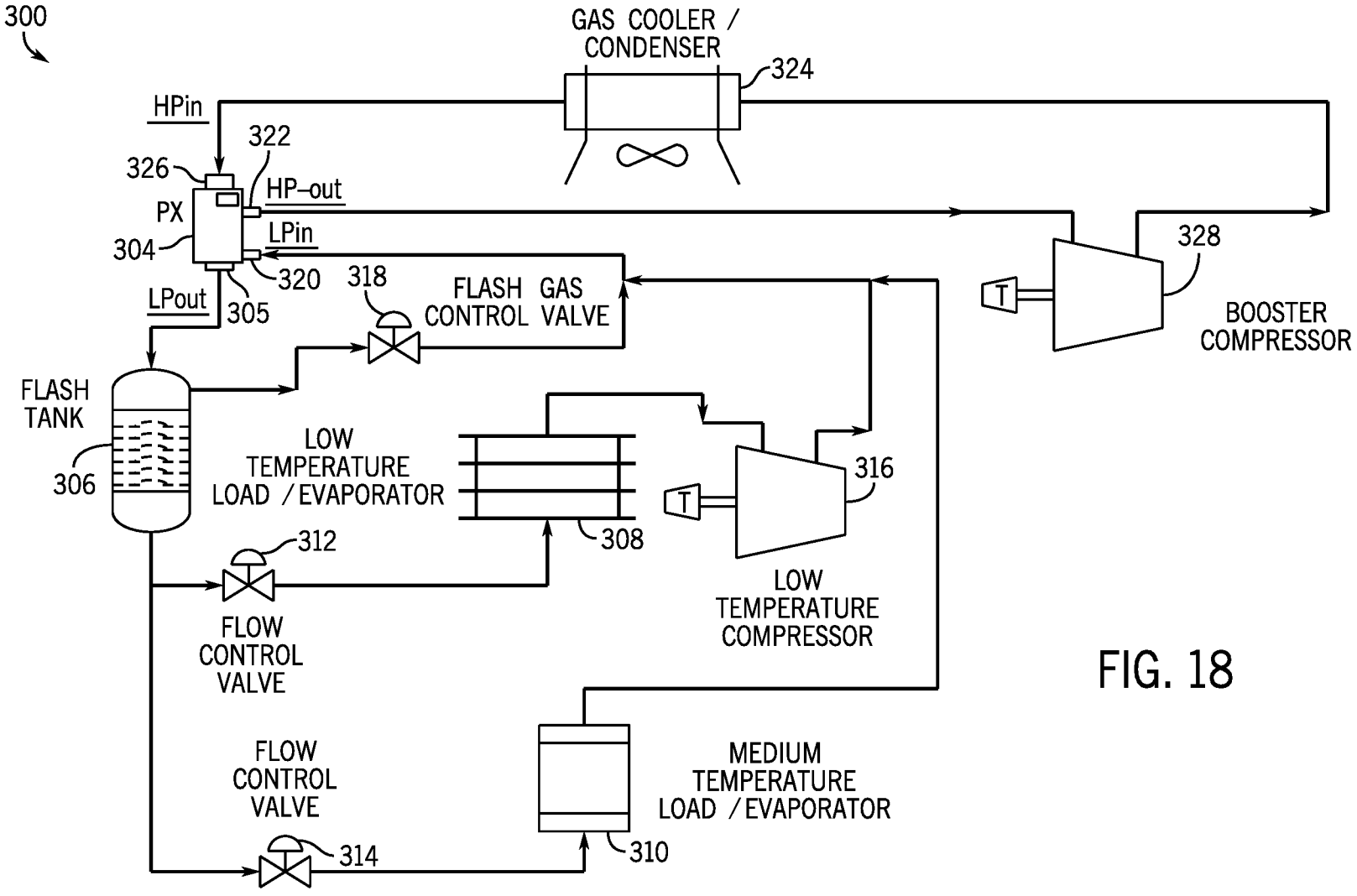
FIG. 18 is a schematic view of an embodiment of a refrigeration system in a supermarket refrigeration system architecture.
Figure 19:
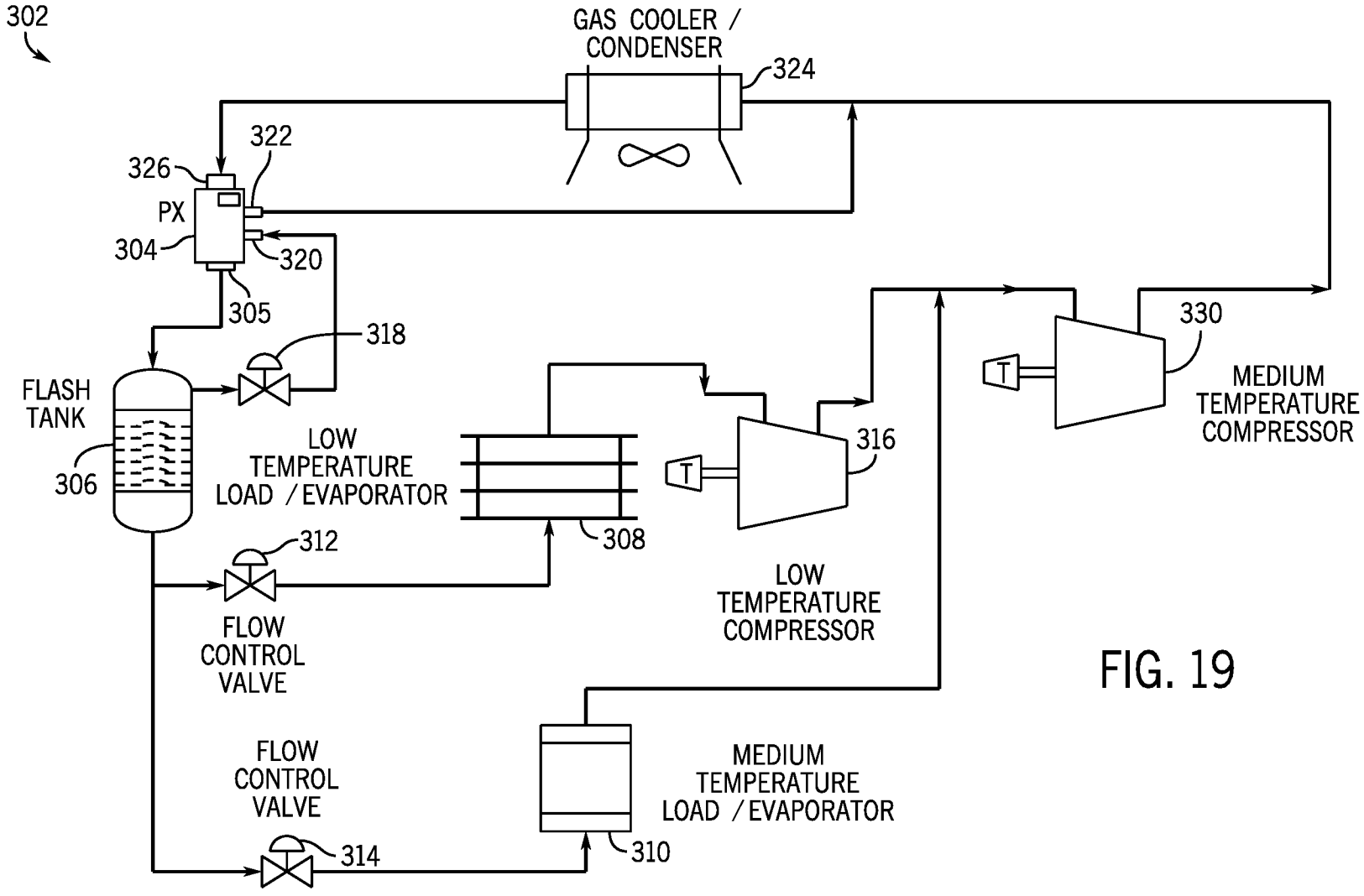
FIG. 19 is a schematic view of an embodiment of a refrigeration system in an alternative supermarket refrigeration system architecture.

FIGS. 18 and 19 illustrate two examples of supermarket system architectures 300, 302 that utilize a rotary pressure exchanger based trans-critical carbon dioxide refrigeration system rather than traditional Joule-Thomson expansion valve based cooling. In the first architecture 300 (FIG. 18), the two-phase, low pressure-out stream (e.g., carbon dioxide gas/liquid mixture) from a rotary pressure exchanger 304 (via low pressure outlet 305) goes through a flash tank 306 which separates the gas and liquid phases. The carbon dioxide liquid phase is transported to low temperature (e.g., approximately −20 degrees Celsius (C)) and medium temperature (e.g., approximately −4 degrees C.) thermal loads/evaporators 308, 310 (e.g., freezer section and fridge section of the supermarket, respectively) where the carbon dioxide liquid phase picks up heat and becomes superheated. Since this is a purely liquid phase, rather than two-phase gas/liquid phase, it has more heat absorption (i.e., cooling) capacity. Flow control valves 312, 314 (e.g., in response to control signals from a controller) may regulate the flow of the liquid carbon dioxide to the respective thermal loads 308, 310. The superheated carbon dioxide vapor from the freezer section 308 then proceeds to a low temperature compressor 316 before subsequently re-uniting with the superheated carbon dioxide vapor from the fridge section 310 and with the separated superheated gas phase carbon dioxide separated from the gas/liquid mixture in the flash tank 306 at same pressure. A control valve 318 (e.g., flash gas control valve) (e.g., in response to control signals from a controller) may regulate the flow of the superheated gaseous carbon dioxide flowing from the flash tank 306. This re-united superheated gaseous carbon dioxide then enters the rotary pressure exchanger 304 at low pressure inlet port 320 and gets compressed to the highest pressure in the system (e.g., approximately 10,342 kPa (1500 psi) or approximately 14,479 kPa (2100 psi) depending on system requirements) and converted to supercritical carbon dioxide. The supercritical carbon dioxide exits the rotary pressure exchanger 304 (via high pressure outlet 322) and proceeds to heat exchanger 324 at highest pressure where it rejects heat to the environment and cools down. In certain embodiments, the heat exchanger 324 is a gas condenser utilized with subcritical carbon dioxide. From the gas cooler 324, the supercritical carbon dioxide flows to a high pressure inlet 326 of the rotary pressure exchanger 304. A small pressure boost required to overcome hydraulic resistance in the system and small differential pressure in the rotary pressure exchanger 304 may be provided by using a small compressor 328 (e.g., low DP circulation compressor) (as shown between the path from the rotary pressure exchanger 304 and the gas cooler 324) with very little energy consumption compared to a traditional compressor.

The heat exchanger 324 is disposed along a high pressure branch for circulating the carbon dioxide at high pressure in a supercritical or subcritical state. The low temperature evaporator 308 and the low temperature compressor 316 are disposed along a low pressure branch for circulating carbon dioxide at a low pressure (i.e., lower than the pressure in the high pressure branch) in a liquid state, gas or vapor state, or a two-phase mixture of liquid and vapor. The medium temperature evaporator 310 and valve 314 are disposed along an intermediate pressure branch that circulates the refrigerant at an intermediate pressure between respective pressures of the refrigerant in the high pressure branch and the low pressure branch. The intermediate pressure of the refrigerant in the intermediate pressure branch is equal to a saturation pressure at the evaporator 310. The refrigerant exiting the flash tank 306 and flowing directly to the inlet 320 of the rotary pressure exchanger 304 is at the intermediate pressure. Thus, the rotary pressure exchanger 304 is fluidly coupled to the intermediate pressure branch and the high pressure branch. The rotary pressure exchanger 304 receives the refrigerant at high pressure from the high pressure branch, receives the refrigerant at the intermediate pressure in the vapor state, the liquid state, or the two-phase mixture of liquid and vapor from the intermediate pressure branch, and exchanges pressure between the refrigerant at high pressure and the refrigerant at the intermediate pressure. From the rotary pressure exchange exits a first exiting stream of the refrigerant at high pressure in the supercritical state or the subcritical state and a second exiting stream of the refrigerant at the intermediate pressure in the liquid state or the two-phase mixture of liquid and vapor.

In the second architecture 302 (FIG. 19), only the separated gas phase carbon dioxide from the flash tank is re-sent through the rotary pressure exchanger 304 at the low pressure inlet 320 and compressed to the highest pressure in the system. The superheated gaseous carbon dioxide from the freezer section 308 and the fridge section 310, respectively, flow to the low temperature compressor 316 and medium temperature compressor 330. The low temperature compressor exit flow combines with the superheated gaseous carbon dioxide from the fridge section 310 prior to the medium temperature compressor 330. The medium temperature compressor exit flow (e.g., supercritical carbon dioxide) combines with the supercritical carbon dioxide exiting the rotary pressure exchanger 304 (via high pressure outlet 322) where it combines with the already compressed low and medium temperature compressor exit flows (superheated gaseous carbon dioxide at same pressure as the flash tank 306) before proceeding through the gas cooler 324. Such an architecture can have advantages in some scenarios of refrigeration.

The heat exchanger 324 is disposed along a high pressure branch for circulating the carbon dioxide at high pressure in a supercritical or subcritical state. The low temperature evaporator 308 and the low temperature compressor 316 are disposed along a low pressure branch for circulating carbon dioxide at a low pressure (i.e., lower than the pressure in the high pressure branch) in a liquid state, gas or vapor state, or a two-phase mixture of liquid and vapor. The medium temperature evaporator 310 and valve 314 are disposed along a first intermediate pressure branch that circulates the refrigerant at a first intermediate pressure between respective pressures of the refrigerant in the low pressure branch and a second intermediate pressure branch. The second intermediate pressure branch is between the flash tank 306 and the rotary pressure exchanger 304. The first intermediate pressure of the refrigerant in the intermediate pressure branch is equal to a saturation pressure at the evaporator 310. The refrigerant exiting the flash tank 306 and flowing directly to the inlet 320 of the rotary pressure exchanger 304 is at a second intermediate pressure between respective pressures of the refrigerant in the high pressure branch and the first intermediate pressure branch. Thus, the rotary pressure exchanger 304 is fluidly coupled to the second intermediate pressure branch and the high pressure branch. The rotary pressure exchanger 304 receives the refrigerant at high pressure from the high pressure branch, receives the refrigerant at the second intermediate pressure in the vapor state, the liquid state, or the two-phase mixture of liquid and vapor from the second intermediate pressure branch, and exchanges pressure between the refrigerant at high pressure and the refrigerant at the second intermediate pressure. From the rotary pressure exchange exits a first exiting stream of the refrigerant at high pressure in the supercritical state or the subcritical state and a second exiting stream of the refrigerant at the second intermediate pressure in the liquid state or the two-phase mixture of liquid and vapor.

Figure 20:
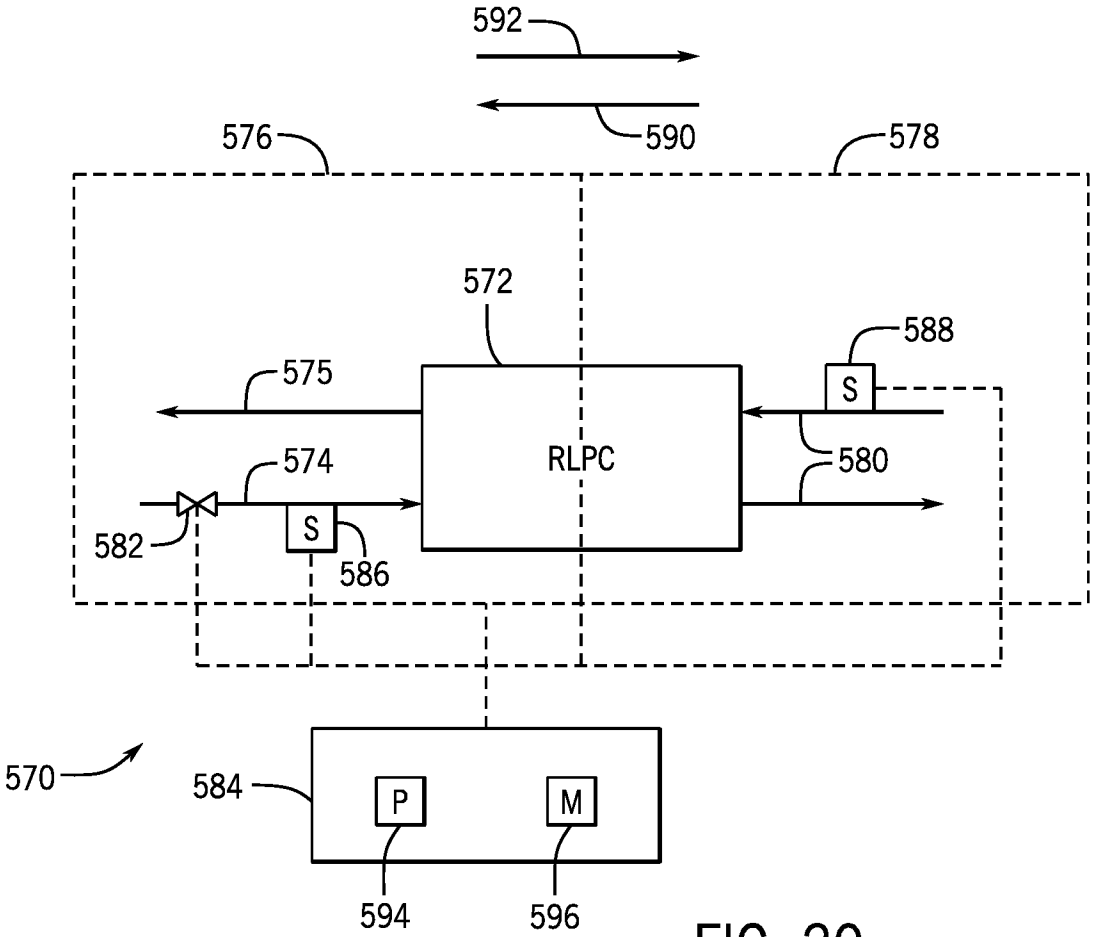
FIG. 20 is a schematic view of an embodiment of a control system that controls the movement of a motive fluid and a working fluid in an RLPC.

FIG. 20 is a schematic view of an embodiment of a control system 570 that controls the movement of fluids (e.g., supercritical carbon dioxide, superheated gaseous carbon dioxide) in a rotary pressure exchanger or rotary liquid piston compressor 572. As explained above, a rotary liquid piston compressor may be used to exchange energy between two fluids. For example, the rotary liquid piston compressor 572 may be used to exchange energy between two fluids in the refrigeration systems described above. In order to reduce and or block the transfer of superheated gaseous carbon dioxide 574 or a two-phase gas/liquid carbon dioxide mixture 575 in a fluid loop 576 from entering a fluid loop 578 circulating working fluid (i.e., superheated carbon dioxide 580), the control system 570 may control the flow rate of the superheated gaseous carbon dioxide 574 into the rotary liquid piston compressor 572 in response to a flow rate of the working fluid 580. That is, by controlling the flow rate of the superheated gaseous carbon dioxide 574, the control system 570 can block and/or limit superheated gaseous carbon dioxide 574 from flowing completely through the rotary liquid piston compressor 572 (i.e., flow completely through the channels 70 seen in FIG. 5) and into the working fluid loop 578.

In order to control the flow rate of the superheated gaseous carbon dioxide 574, the control system 570 includes a valve 582, which controls the amount of the superheated gaseous carbon dioxide 574 entering the rotary liquid piston compressor 572. The sensors 586 and 588 sense the respective flowrates of the superheated gaseous carbon dioxide 574 and working fluid 580 and emit signals indicative of the flowrates. That is, the sensors 586 and 588 measure the respective flowrates of the superheated gaseous carbon dioxide 574 and working fluid 580 into the rotary liquid piston compressor 572. The controller 584 receives and processes the signals from the sensors 586, 588 to detect the flowrates of the superheated gaseous carbon dioxide 574 and working fluid 580.

In response to the detected flowrates, the controller 584 controls the valve 582 to block and/or reduce the transfer of the superheated gaseous carbon dioxide 574 into the working fluid loop 578. For example, if the controller 584 detects a low flowrate with the sensor 588, the controller 584 is able to associate the flowrate with how far the working fluid entered the rotary liquid piston compressor 572 in direction 590. The controller 584 is therefore able to determine an associated flowrate of the superheated gaseous carbon dioxide 574 into the rotary liquid piston compressor 572 that drives the working fluid 580 out of the rotary liquid piston compressor 572 in direction 592 without driving the superheated gaseous carbon dioxide 574 out of the rotary liquid piston compressor 572 in the direction 592. In other words, the controller 584 controls the valve 582 to ensure that the flowrate of the working fluid 580 into the rotary liquid piston compressor 572 is greater than the flowrate of the superheated gaseous carbon dioxide 574 to block the flow of superheated gaseous carbon dioxide 574 into the working fluid loop 578.

As illustrated, the controller 584 may include a processor 594 and a memory 596. For example, the processor 594 may be a microprocessor that executes software to process the signals from the sensors 586, 588 and in response control the operation of the valve 582.

Figure 21:
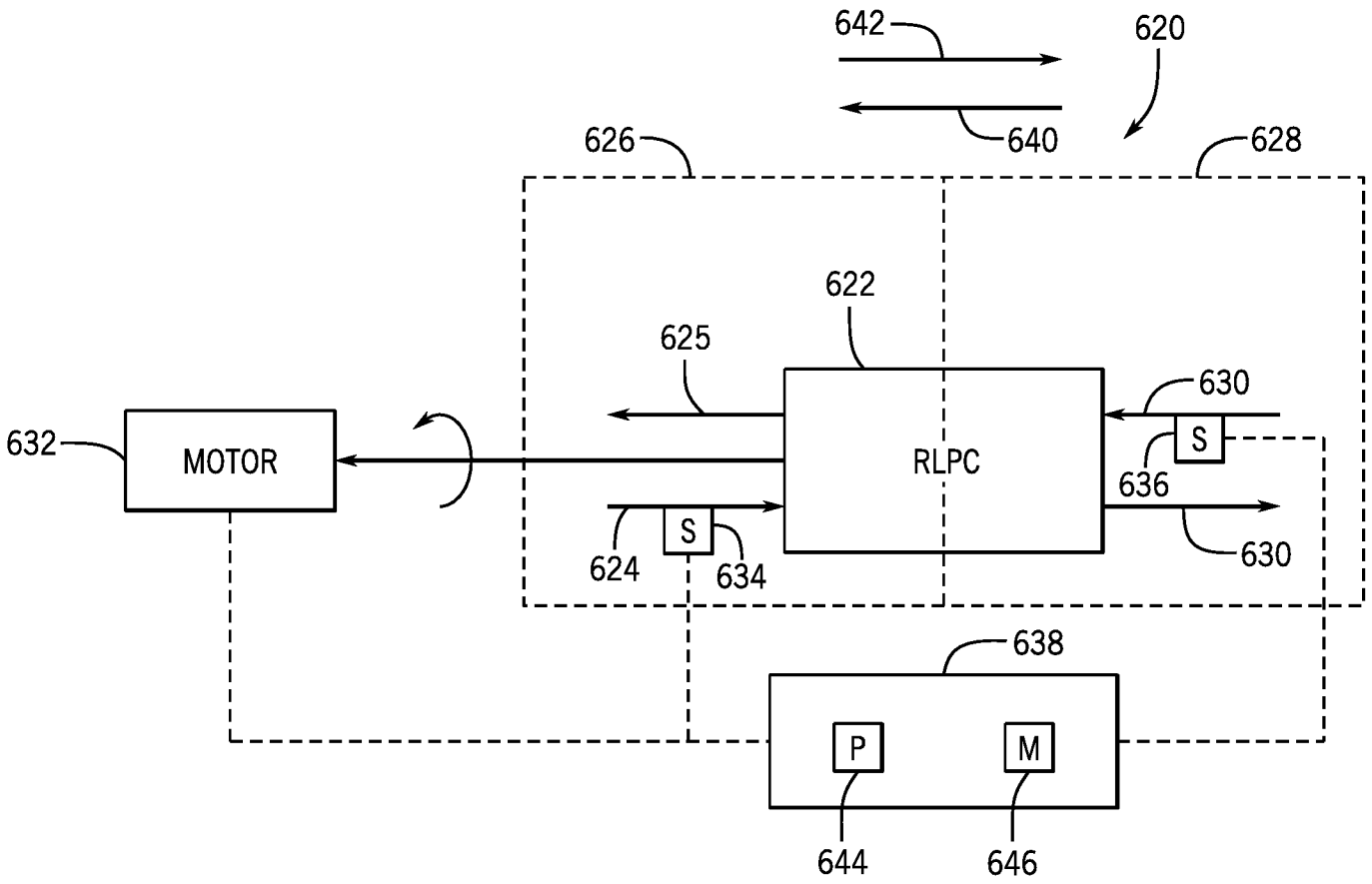
FIG. 21 is a schematic view of an embodiment of a control system that controls the movement of a motive fluid and a working fluid in an RLPC.

FIG. 21 is a schematic view of an embodiment of a control system 620 that controls the movement of fluids (e.g., supercritical carbon dioxide, superheated gaseous carbon dioxide) in a rotary liquid piston compressor 622. As explained above, a rotary liquid piston compressor or pump may be used to exchange energy between two fluids. For example, the rotary liquid piston compressor 622 may be used to exchange energy between two fluids in the refrigeration systems described above. In order to reduce and or block the transfer of superheated gaseous carbon dioxide 624 or a two-phase gas/liquid carbon dioxide mixture 625 in a fluid loop 626 from entering a working fluid loop 628 circulating a working fluid 630 (e.g., supercritical carbon dioxide), the control system 620 may control the distance the superheated gaseous carbon dioxide travels axially within a rotor channel of the rotary liquid piston compressor 622 in response to the flow rate of the working fluid 630 and the flow rate of the superheated gaseous carbon dioxide 624. The control system 620 controls the movement of the motive fluid by slowing down or speeding up the rotational speed of the rotor of the rotary liquid piston compressor 622. That is, by controlling the rotational speed, the control system 620 can block and/or limit the superheated gaseous carbon dioxide 624 from flowing completely through the rotary liquid piston compressor 622 (i.e., flow completely through the channels 70 seen in FIG. 5) and into the working fluid loop 628.

In order to reduce the mixing of superheated gaseous carbon dioxide 624 with the working fluid 630, the control system 620 includes a motor 632. The motor 632 controls the rotational speed of the rotor (e.g., rotor 46 seen in FIG. 5) and therefore to what axial length the superheated gaseous carbon dioxide 624 can flow into the channels of the rotor. The faster the rotor spins the less time the superheated gaseous carbon dioxide and working fluid have to flow into the channels of the rotor and thus superheated gaseous carbon dioxide/process fluid occupies a smaller axial length of the rotor channel. Likewise, the slower the rotor spins the more time the superheated gaseous carbon dioxide and the working fluid have to flow into the channels of the rotor and thus superheated gaseous carbon dioxide/process fluid occupies a larger axial length of the rotor channel.

The control system 620 may include a variable frequency drive for controlling the motor and sensors 634 and 636 that sense the respective flowrates of the superheated gaseous carbon dioxide 624 and working fluid 630 and emit signals indicative of the flowrates. The controller 638 receives and processes the signals to detect the flowrates of the superheated gaseous carbon dioxide 624 and working fluid 630. In response to the detected flowrates, the controller 638 sends a command to the variable frequency drive that controls the speed of the motor 632 to block and/or reduce the transfer of the superheated gaseous carbon dioxide 624 into the working fluid loop 578. For example, if the controller 638 detects a low flowrate of the working fluid 630 with the sensor 636, the controller 638 is able to associate the flowrate with how far the working fluid has moved into the channels of the rotary liquid piston compressor 622 in direction 640. The controller 638 is therefore able to determine an associated speed of the motor 632 that drives the working fluid 630 out of the rotary liquid piston compressor 622 in direction 642 without driving the superheated gaseous carbon dioxide 624 out of the rotary liquid piston compressor 622 in the direction 642.

In response to a low instantaneous flowrate of the working fluid with respect to superheated gaseous carbon dioxide, the controller 638 controls the motor 632 through a variable frequency drive to increase the rotational speed of the rotary liquid piston compressor 622 (i.e., increase the rotations per minute) to reduce the axial length that the superheated gaseous carbon dioxide 624 can travel within the channels of the rotary liquid piston compressor 622. Likewise, if the instantaneous flowrate of the working fluid 630 is too high with respect to the motive fluid, the controller 638 reduces the rotational speed of the rotary liquid piston compressor 622 to increase the axial distance traveled by the superheated gaseous carbon dioxide 624 into the channels of the rotary liquid piston compressor 622 to drive the working fluid 630 out of the rotary liquid piston compressor 622.

As illustrated, the controller 638 may include a processor 644 and a memory 646. For example, the processor 644 may be a microprocessor that executes software to process the signals from the sensors 634, 636 and in response control the operation of the motor 632.

Figure 22A:
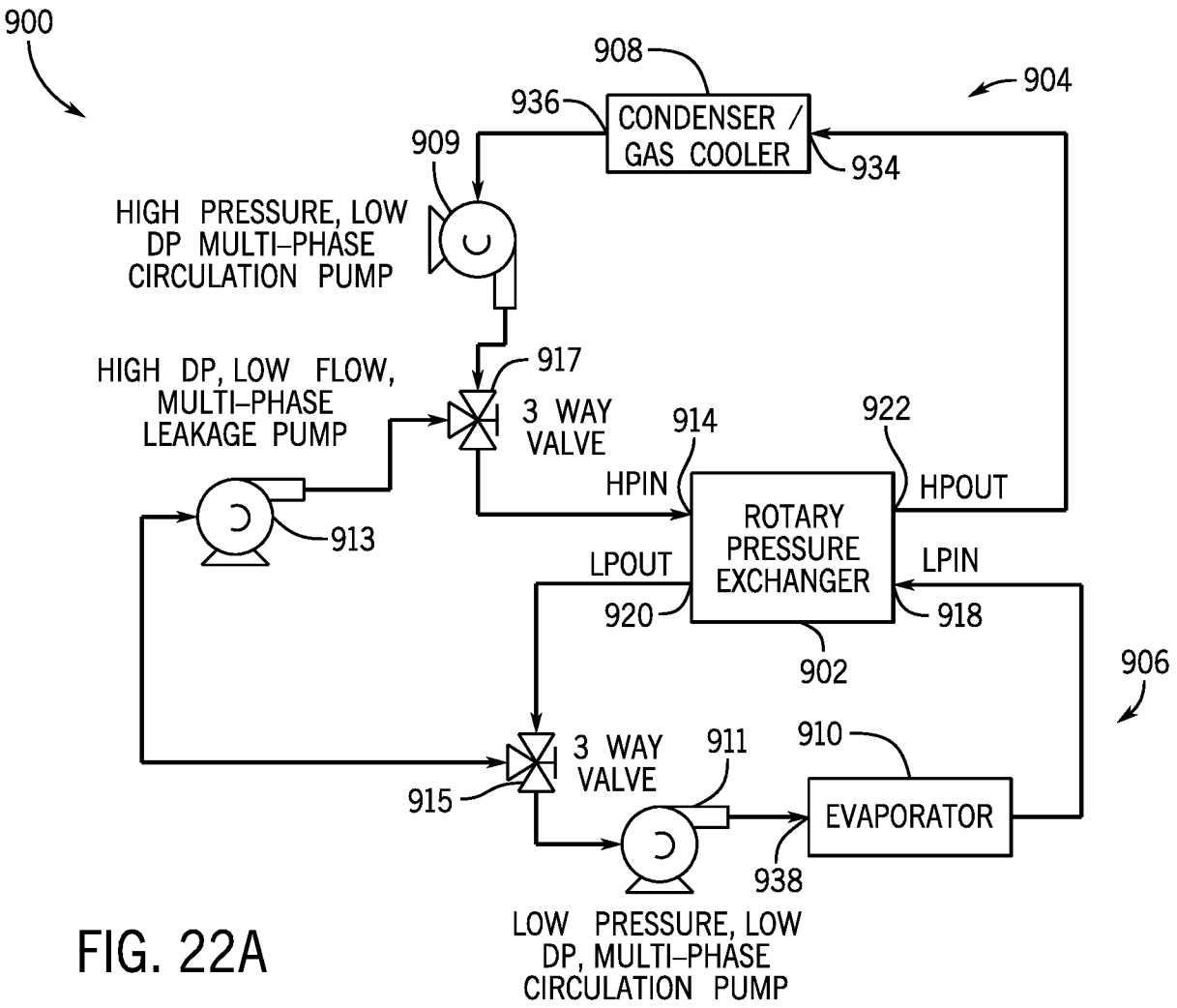
FIG. 22A is a schematic view of an embodiment of a refrigeration system with a rotary pressure exchanger or rotary liquid piston compressor (LPC) (e.g., having a low flow, high differential pressure (DP) leakage pump and low DP, high flow circulation pumps in place of a bulk flow compressor)

As noted above, since almost all of the compression happens inside the rotary pressure exchanger, in certain embodiments, the main compressor (e.g., bulk flow compressor) may be completely or partially eliminated. For example, the compressor can be replaced by a very low differential pressure gas blower or a circulation pump which consumes very little work (due to very little enthalpy change across it). FIG. 22A is a schematic view of an embodiment of a refrigeration system 900 (e.g., trans-critical carbon dioxide refrigeration system) with a rotary pressure exchanger or rotary liquid piston compressor (LPC) 902 (e.g., having a low flow high DP leakage pump and low DP, high flow circulation pumps in place of a bulk flow compressor). In general, the refrigeration system 900 is similar to refrigeration system 800 in FIG. 2.

As depicted, the refrigeration system 900 includes a first fluid loop 904 and a second fluid loop 906. The first fluid loop (high pressure loop) 904 includes a gas cooler or condenser 908, a high pressure, high flow, low DP multi-phase circulation pump 909, and the high pressure side of the rotary pressure exchanger 902. The second fluid loop (low pressure loop) 906 includes an evaporator 910 (e.g., cooling or thermal load), a low pressure, high flow, low DP multi-phase circulation pump 911 and the low pressure side of the rotary pressure exchanger 902. The rotary pressure exchanger 902 fluidly couples the high pressure and low pressure loops 904, 906. Additionally, a multi-phase leakage pump 913, which operates with low flow but high DP, takes any leakage from the pressure exchanger 902 existing at low pressure from low pressure outlet 920 and pumps it back into the high pressure loop 904, just upstream of the high pressure inlet 914 of the pressure exchanger 902. The multi-phase pump 909 in the high pressure loop 904 ensures a required flow rate is maintained in the high pressure loop 904 by overcoming small pressure losses in the loop 904. Since there is not much of a pressure differential across pump 909, it consumes very little energy. The flow coming into this multi-phase pump 909 is from the exit 936 of the gas cooler/condenser 908 and can be in the supercritical state, liquid state or could be a two-phase mixture of liquid and vapor. Since there is not much of a pressure rise across the pump 909, the flow exiting the pump 909 would be in the same state as the incoming flow which then enters the high pressure inlet 914 of the pressure exchanger 902. The flow from the low pressure outlet 920 of the pressure exchanger 902 could be in the two-phase liquid-vapor state or pure liquid state.

The multi-phase pump 913 in low pressure loop 906 circulates this bulk low pressure flow of the refrigerant through the evaporator 910 and sends it to the low pressure inlet 918 of the pressure exchanger 902. The multi-phase pump 913 also has very little differential pressure across it (i.e., just enough to overcome any pressure loss in the system) and thus the pump 913 consumes very little energy compared to traditional bulk flow high differential pressure compressors. The low pressure multi-phase pump 913 circulates the flow through the evaporator 910, gaining heat in the evaporator 910, and transforming itself into pure vapor state or into two-phase liquid vapor mixture of higher vapor content. This high vapor content flow then enters the low pressure inlet 918 of the pressure exchanger 902 and gets pressurized to high pressure. This in turn also increases the fluid's temperature per the standard laws of thermodynamics. This high pressure, higher temperature fluid then exits the high pressure outlet 922 of the pressure exchanger 902. The fluid exiting high pressure outlet 922 could either be in supercritical state or could exist in subcritical vapor or as a mixture of liquid and vapor with high vapor content depending on how the system is optimized. This high pressure, high temperature refrigerant then enters the gas cooler/condenser 908 of the high pressure loop 904 and rejects heat to the ambient environment. By rejecting heat, the refrigerant either cools down (if in supercritical state) or changes phase to liquid state. The multi-phase pump 909 in the high pressure loop 904 then receives this liquid refrigerant and circulates it through the high pressure loop 904 as described earlier.

If there is no internal leakage in the pressure exchanger 902, then the high pressure loop 904 will remain at constant high pressure and the low pressure loop 906 will remain at a constant low pressure. However, if there is internal leakage from the high pressure side to the low pressure side inside the pressure exchanger 902, then there would be net migration of flow from the high pressure loop 904 to the low pressure loop 906. To account for this migration and to pump this leakage flow back into the high pressure loop 904, a third multi-phase pump 913 which is a high differential pressure, low flow leakage pump, is utilized. The pump 913 takes any extra flow leaking into the low pressure loop 906 at low pressure and pumps it back into the high pressure loop 904 to maintain mass balance and pressures in the respective loops 904, 906. A three-way valve 915 is disposed in the low pressure loop 906 between the low pressure outlet 920 of the pressure exchanger 902 and an inlet of the low pressure multi-phase pump 911. The valve 915 enables splitting of the flow and directing only the excess flow coming out of the low pressure outlet 920 of the pressure exchanger 902 to the high DP multi-phase pump 913. The pump 913 also enables pumping of any additional flow coming out of the low pressure outlet 920 due to compressibility of the refrigerant and due to density differences between the four streams entering and leaving the pressure exchanger 902. The pump 913 also helps maintain the pressure of the low pressure loop 906 at a constant low pressure and the pressure of the high pressure loop 904 at a constant high pressure. Another three-way valve 917 is disposed in the high pressure loop 904 between an exit of high pressure multi-phase pump 909 and the high pressure inlet 94 of the pressure exchanger 902. The valve 917 enables combining the leakage/excess flow coming from high DP multi-phase pump 913 with the high pressure bulk flow coming from high pressure multi-phase pump 909 before sending it into the high pressure inlet 914 of the pressure exchanger 902. Although the differential pressure across the multi-phase pump 913 is high, the flow it has to pump is very little (e.g., approximately 1 to 10 percent of the bulk flow going through any of the other two pumps 909, 911). Thus, the energy consumption of the pump 913 is also relatively low. When one adds the energy consumption of all the three multi-phase pumps 909, 911, 913, it would still be much lower than the energy consumption of a traditional compressor which is used to pressurize the entire bulk flow from the lowest pressure in the system (i.e. evaporator pressure) to the highest pressure in the system (i.e. condenser/gas cooler pressure). This is the main advantage of this configuration.

Figure 22B:
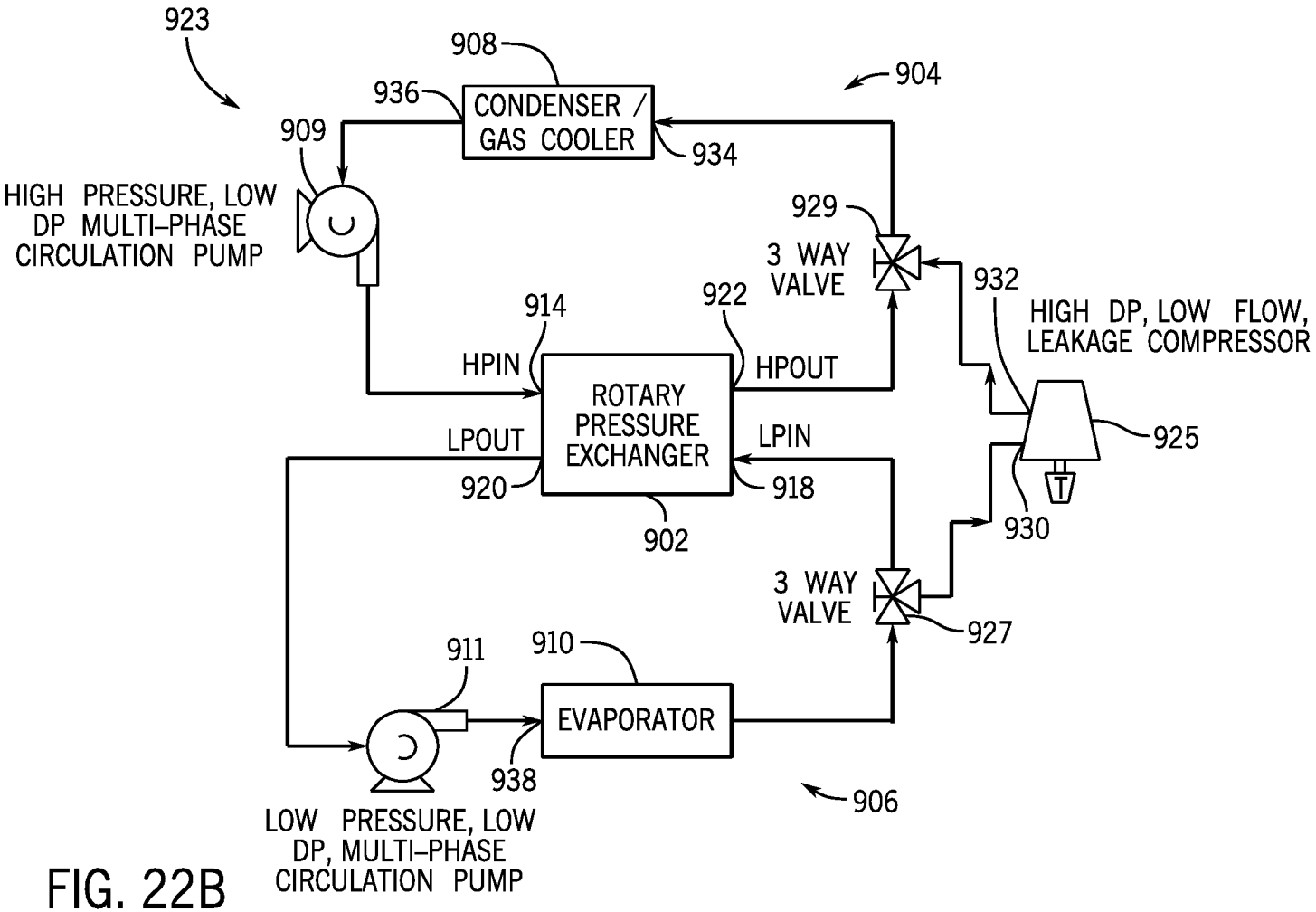
FIG. 22B is a schematic view of an embodiment of a refrigeration system with a rotary pressure exchanger or rotary liquid piston compressor (LPC) (e.g., having a leakage compressor in place of a bulk flow compressor)

FIG. 22B demonstrates another embodiment of a refrigeration system 923 without the bulk flow compressor. It is similar to the system 900 shown in FIG. 22A except that any excess flow (due to internal leakage of pressure exchanger 902 or due to compressibility and density differences of the four streams entering and exiting the pressure exchanger 902 as described earlier) exiting the low pressure outlet 920 of pressure exchanger 902 is pumped through the evaporator 910 along with the bulk low pressure flow and is converted to vapor before being compressed back into the high pressure loop 904. Thus, the high DP, low flow multi-phase leakage pump 913 of FIG. 22A is replaced by a high DP, low flow leakage compressor 925 as shown in FIG. 22B. The leakage compressor 925 compresses the excess flow in low pressure vapor state to a high pressure vapor state or to a supercritical state before injecting it into the high pressure loop 904. The location of this re-injection of the excess flow is also different compared to that in FIG. 22A. The vapor state or supercritical state refrigerant exiting the leakage compressor 925 is injected downstream of the high pressure outlet 922 of the pressure exchanger 902 (which is at the same pressure as the leakage compressor exit pressure). As shown in FIG. 22B, a three-way valve 927 is disposed downstream of the evaporator 910 to enable splitting of the excess flow from the bulk flow in low pressure loop 906 before sending it through the leakage compressor 925. Similarly, a three-way valve 929 is disposed downstream of the pressure exchanger 902 to enable recombination of the high pressure leakage flow exiting the leakage compressor 925 with the high pressure bulk flow exiting the pressure exchanger 922. This combined high pressure flow then proceeds to the gas cooler/condenser 908 as described earlier. The advantage of this configuration over that in FIG. 22A is that it provides additional heat absorption capacity to the cycle due to additional flow (excess flow coming from low pressure outlet 920) passing through the evaporator 910. On the other hand, the energy consumption of this cycle would be a little more compared to that of the system 900 shown in FIG. 22A, since the energy consumed by the leakage compressor 925 would be a little higher than that consumed by the multi-phase leakage pump 913. This is because the refrigerant is compressed to high pressure completely in vapor state in the leakage compressor 925 as opposed to being pumped in a partial or complete liquid state in a multi-phase leakage pump 913.

Figure 24:
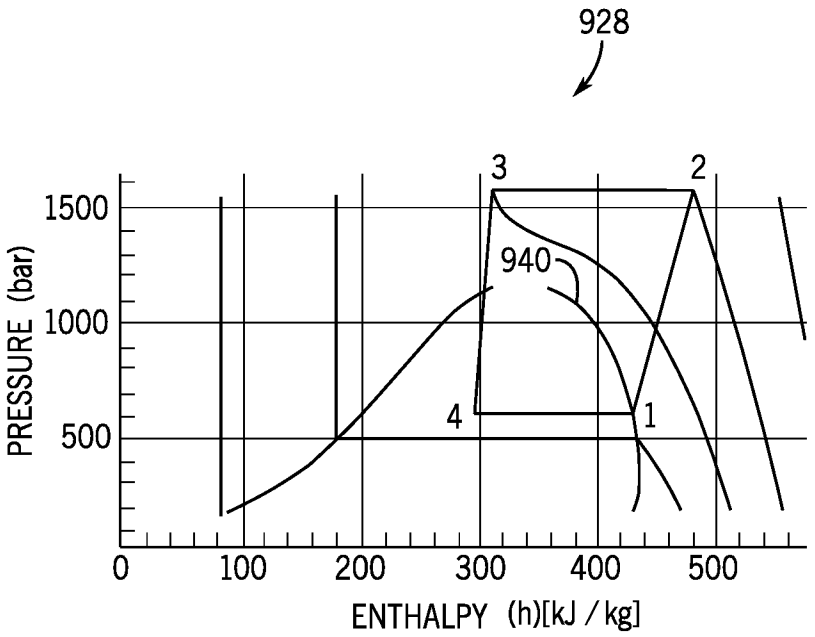
FIG. 24 is a pressure-enthalpy diagram of thermodynamic processes in the refrigeration system of FIG. 22.
Figure 23:
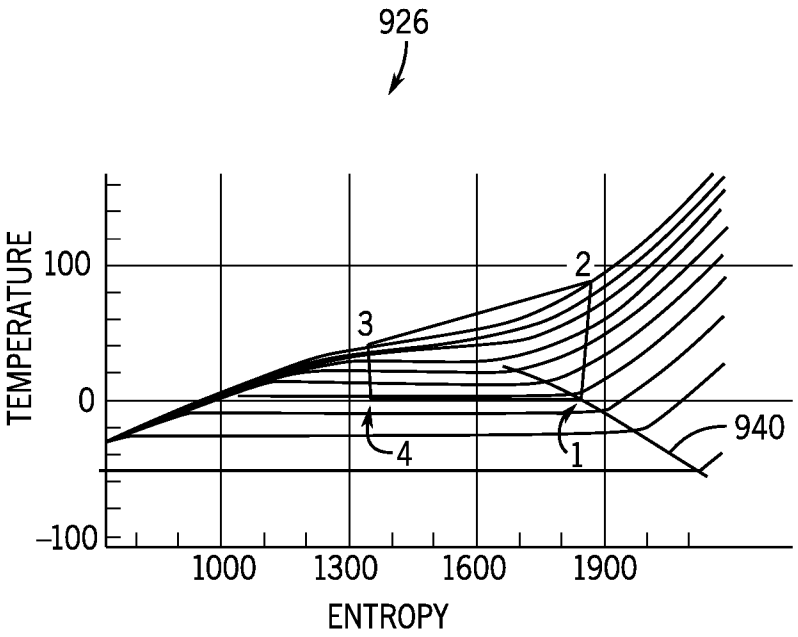
FIG. 23 is a temperature-entropy diagram of thermodynamic processes in the refrigeration system of FIG. 22.

The thermodynamic processes occurring in the refrigeration system 923 are described in greater detail with reference to FIGS. 23 and 24. FIGS. 23 and 24 illustrate a temperature-entropy (T-S) diagram 926 and pressure-enthalpy (P-H) diagram 928, respectively, to show the thermodynamic processes occurring at the four main components of the refrigeration system 900. Point 1 represents leakage compressor inlet 930 (see FIG. 22B). Point 2 represents leakage compressor exit 932 and gas cooler inlet 934. Point 3 represents gas cooler exit 936 and high pressure inlet 914 of the rotary pressure exchanger 902. Point 4 represents the low pressure outlet 920 of the rotary pressure exchanger 902 and evaporator inlet 938. As illustrated in FIGS. 23 and 24, leakage compressor 932 increases the pressure and thus the temperature of the refrigerant working fluid (e.g., carbon dioxide) to temperatures higher than the environment where it can reject heat to the outside hotter environment. This occurs inside the gas cooler 908. In the trans-critical carbon dioxide system's gas cooler 908, since the carbon dioxide is in supercritical state, the phase boundary does not exist and the carbon dioxide is above two-phase dome 940. Thus, the temperature drops when carbon dioxide rejects heat to the environment. As illustrated in FIGS. 23 and 24, the carbon dioxide in supercritical state at gas cooler exit 936 enters the rotary pressure exchanger 902 at high pressure inlet port 914 and undergoes an isentropic or close to isentropic (approximately 85 percent isentropic efficiency) expansion and exits at low pressure outlet port 920 of the rotary pressure exchanger 902 as a two-phase gas-liquid carbon dioxide mixture. The two-phase carbon dioxide at point 4 then proceeds to absorb heat in the evaporator 910 (process 4→1, a constant enthalpy process). Overall, the diagrams 926, 928 illustrate the cycle efficiency benefits due to increased cooling capacity and reduced compressor workload. Since expansion within the rotary pressure exchanger 902 occurs isentropically, it creates an enthalpy change that can be utilized to compress the fluid coming out of the evaporator 910 to a full high pressure in the system 900. This significantly reduces any work that would have been done by a bulk flow compressor, thus, enabling its replacement by the leakage compressor 925 (which consumes significantly less energy).

Figure 25:
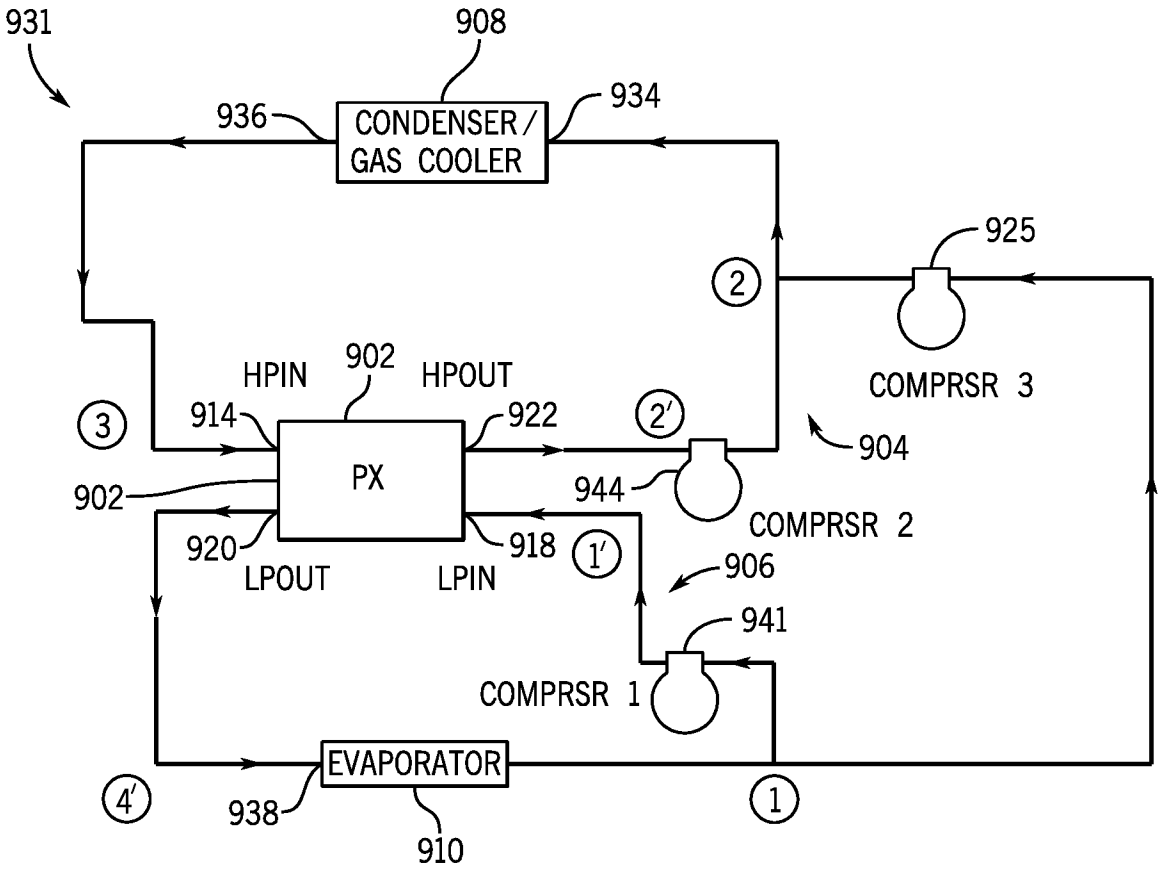
FIG. 25 is a schematic view of an embodiment of a refrigeration system with a rotary pressure exchanger or rotary liquid piston compressor (LPC) (e.g., having a leakage compressor in place of a bulk flow compressor and additional low DP circulation compressors (e.g. blowers))

FIG. 25 is a schematic view a refrigeration system 931 that uses low DP circulation compressors instead of circulation pumps. The circulation compressors overcome the minimal pressures losses in the system 931 by maintaining fluid flow throughout the system 900. The difference between this system and systems 900, 923 shown in FIG. 22A and FIG. 22B is that the bulk flow circulation in the low pressure loop 906 and the high pressure loop 904 is achieved using low DP circulation compressors instead of using low DP multi-phase circulation pumps. Also, the location of these circulation compressors is different. For example, the circulation compressor 941 in low pressure loop 904 (compressor 1) is positioned downstream of the evaporator 910 where it circulates the refrigerant in vapor state. Similarly, the circulation compressor 944 in the high pressure loop 904 (compressor 2) is positioned downstream of the high pressure outlet 922 of the pressure exchanger 902, where it circulates refrigerant in supercritical state or in high pressure vapor state. Compressor 3 is similar to the high DP, low flow leakage compressor 925 described in reference to FIG. 22B, where the compressor 925 takes the excess flow entering the low pressure loop 904 from the pressure exchanger 902 (e.g., leakage flow from the pressure exchanger 902) in vapor state and compresses it back into the high pressure loop 904 as high pressure vapor state or in supercritical state. This excess flow then combines with the high pressure bulk flow coming out of compressor 944 before proceeding to the gas cooler/condenser 934. The low DP circulation compressor 941 disposed along the second fluid loop 906 (e.g., low pressure fluid loop) maintains fluid flow along the loop 906 (e.g., between the rotary pressure exchanger 902 and the gas cooler 908). Further, the low DP circulation compressor 944 disposed along the first fluid loop 904 (e.g., high pressure fluid loop) maintains fluid flow along the loop 904 (e.g., between the evaporator 910 and the rotary pressure exchanger 902). In certain embodiments, the refrigeration system 931 may only include the compressors 925 and 941. In certain embodiments, the refrigeration system 900 may only include the compressors 944 and 941. In certain embodiments, the compressors 941, 944, each have a differential pressure across them that are significantly less than the leakage compressor 925 as noted in greater detail below.

In certain embodiments, a three-way valve is disposed at a junction between the flows exiting the compressors 925, 944 (e.g., near the 2 within the circle in FIG. 25). This three-way valve is disposed between the high pressure, high flow, low DP circulation compressor 944 and the gas cooler or the condenser 908 in the high pressure loop 904, wherein, during operation of the refrigeration system 931, a first flow from the high DP, low flow leakage compressor 925 combines with a bulk flow exiting from the high pressure, high flow, low DP circulation compressor 944 before proceeding to the inlet 934 of the gas cooler or the condenser 908. The high pressure, high flow, low DP circulation compressor 944 is disposed between the high pressure outlet 922 of the rotary pressure exchanger 902 and this three-way valve.

Also, in certain embodiments, another three-way valve is disposed at a junction (e.g., near the 1 within the circle in FIG. 25) downstream of the evaporator 910 that branches towards the compressors 925, 941. This three-way valve is disposed between the evaporator 910 and the rotary pressure exchanger 902 in the low pressure loop 906, wherein, during operation of the refrigeration system 931, a portion of a flow exiting the evaporator 910 is diverted through the three-way valve to an inlet of the high DP, low flow leakage compressor 925 and a remaining portion of the flow proceeds to the low pressure inlet 918 of the rotary pressure exchanger 902. The low pressure, high flow, low DP circulation compressor is disposed between this three-way valve and the low pressure inlet of the rotary pressure exchanger 902.

In a traditional refrigeration system (i.e., trans-critical carbon dioxide refrigeration system), the bulk flow compressor operates with a flow rate of approximately 113.56 liters (30 gallons) per minute and a pressure differential of approximately 10,342 kPa (1,500 psi). Assuming these operating conditions, the bulk flow compressor would require approximately 45,000 (i.e., 30 times 1,500 psi) units of power (i.e., work done or energy consumed). In the refrigeration system 900 above, the low DP circulation compressor 941 and the low DP circulation compressor 944 (assuming each operate with a flow rate of approximately 113.56 liters (30 gallons) per minute and a pressure differential of approximately 68.9 kPa (10 psi)) would each require approximately 300 (i.e., 30 times 10) units of power. The leakage compressor 925 (assuming it operates with a flow rate of approximately 5.68 liters (1.5 gallons) and a differential pressure of approximately 10,342 kPa (1,500 psi)) would require approximately 2,250 (i.e., 1.5 times 1,500) units of power. Thus, the compressors 925, 941, 944 in the refrigeration system 931 would require approximately 2,850 units of power. Thus, the compressors 925, 941, 944 would reduce energy consumption by a least a factor of 10 (or even up to a factor of 15) compared to the bulk flow compressor based system.

In certain embodiments, the refrigeration system 931 (with the leakage compressor 925 and one or more of the low DP circulation compressors 941, 944) may be utilized in the supermarket architectures described above in FIGS. 18 and 19.

Figure 26:
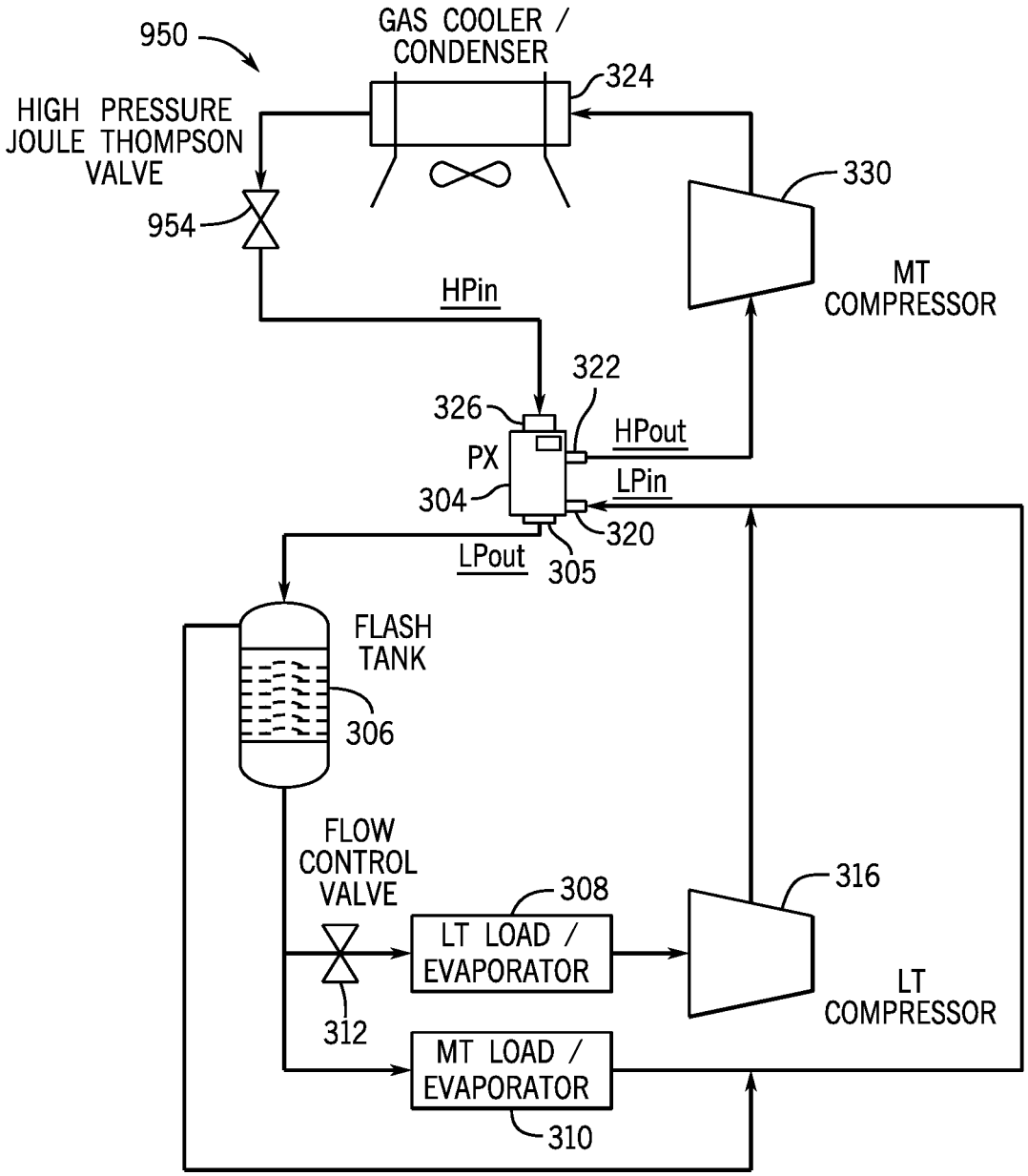
FIG. 26 is a schematic view of an embodiment of a refrigeration system in a supermarket refrigeration system architecture (e.g., having an expansion valve)
Figure 27:
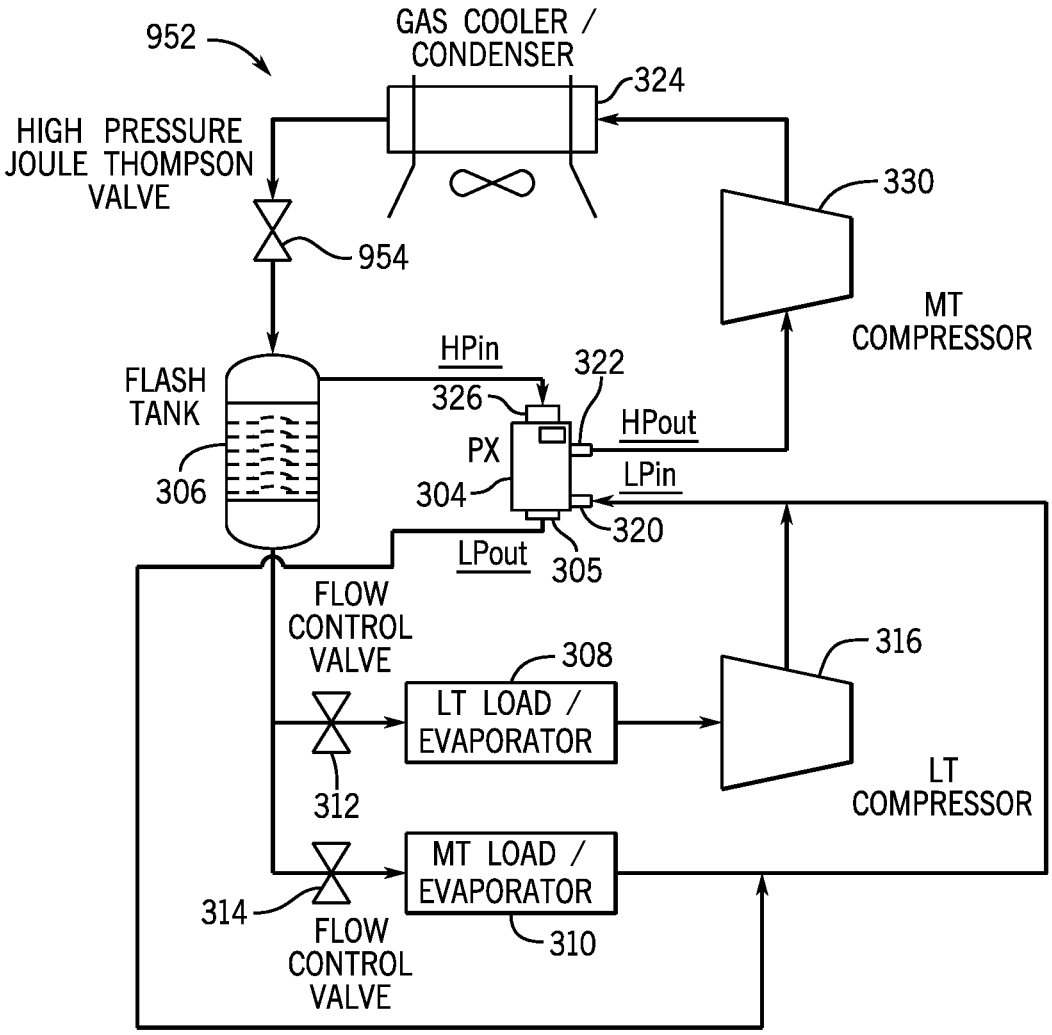
FIG. 27 is a schematic view of an embodiment of a refrigeration system in a supermarket refrigeration system architecture (e.g., having an expansion valve).

FIGS. 26 and 27 illustrate two examples of supermarket system architectures 950, 952 that utilize a rotary pressure exchanger based trans-critical carbon dioxide refrigeration system that also utilizes a traditional Joule-Thomson expansion valve 954. In general, the architectures are similar to those in FIGS. 18 and 19 except for the usage of the expansion valve 954. In addition, although the architectures 950, 952 are discussed in reference to utilizing a gas cooler for the heat exchanger 324 for utilization with supercritical refrigerant (e.g., carbon dioxide), the architectures 950, 952 may be utilized with a condenser as the heat exchanger 324 for utilization with subcritical refrigerant (e.g., carbon dioxide). The first architecture 950 (FIG. 26), the two-phase, low pressure-out stream (e.g., carbon dioxide gas/liquid mixture at a first intermediate pressure e.g., 370 psi) from a rotary pressure exchanger 304 (via low pressure outlet 305) goes through a flash tank 306 which separates the gas and liquid phases (which both exit the flash tank at e.g., 370 psi). The carbon dioxide liquid phase is transported to low temperature (e.g., approximately −20 degrees Celsius (C)) and medium temperature (e.g., approximately −4 degrees C.) thermal loads/evaporators 308, 310 (e.g., freezer section and fridge section of the supermarket, respectively) where the carbon dioxide liquid phase picks up heat and becomes superheated. Since this is a purely liquid phase, rather than two-phase gas/liquid phase, it has more heat absorption (i.e., cooling) capacity. The carbon dioxide liquid phase enters the medium temperature evaporator 310 at e.g. 370 psi, while carbon liquid phase enters the low temperature evaporator 308 at e.g. 180 psi after flowing through flow control valve 312. Flow control valves 312 (e.g., in response to control signals from a controller) may regulate the flow of the liquid carbon dioxide to the evaporator 308. The superheated carbon dioxide vapor (at a low pressure of 180 psi) from the freezer section 308 then proceeds to a low temperature compressor 316 (where it exits at e.g., 370 psi) before subsequently re-uniting with the superheated carbon dioxide vapor from the fridge section 310 (at e.g., 370 psi) and with the separated superheated gas phase carbon dioxide separated from the gas/liquid mixture in the flash tank 306 at same pressure. A control valve 318 (e.g., flash gas control valve) (e.g., in response to control signals from a controller) may regulate the flow of the superheated gaseous carbon dioxide flowing from the flash tank 306. This re-united superheated gaseous carbon dioxide then enters the rotary pressure exchanger 304 at low pressure inlet port 320 and gets compressed to second intermediate pressure (e.g., 500 psi). The superheated gaseous carbon dioxide exits the rotary pressure exchanger 304 (via high pressure outlet 322) and proceeds to the medium temperature compressor 330 where superheated gaseous carbon dioxide is compressed to the highest pressure in the system (e.g., 1,300 psi) depending on system requirements) and converted to supercritical carbon dioxide. The supercritical carbon dioxide then proceeds to heat exchanger 324 (e.g., gas cooler) at highest pressure where it rejects heat to the environment and cools down. In certain embodiments, the heat exchanger 324 is a gas condenser utilized with subcritical carbon dioxide. From the gas cooler 324, the supercritical carbon dioxide (at e.g., 1,300 psi) flows through the high pressure Joule-Thomson valve 954 where the supercritical carbon dioxide is converted to a carbon dioxide gas/liquid mixture (e.g., at a second intermediate pressure, e.g., 500 psi). The carbon dioxide gas/liquid mixture flows into a high pressure inlet 326 of the rotary pressure exchanger 304.

The architecture 952 in FIG. 27 slightly varies from the architecture 950 in FIG. 26. In particular, as depicted in FIG. 27, the carbon dioxide gas/liquid mixture (at the second intermediate pressure, e.g., 500 psi) flows into the flash tank 306 for the separation into pure carbon dioxide gas or vapor and liquid. The carbon dioxide gas from the flash tank 306 flows into the high pressure inlet 326 of the rotary pressure exchanger 304, while the carbon dioxide liquid from the flash tank flows into the low pressure into low and medium temperature evaporators 308, 310. The two-phase gas liquid $CO_2$ mixture exiting the low pressure outlet 305 of the pressure exchanger 304 exits at the same pressure as the medium temperature evaporator 310 and is combined with the fluid stream exiting the medium temperature evaporator 310 and the low temperature compressor 316 before entering the low pressure inlet 320 of the pressure exchanger 304. Also, the flow control valve 314 is disposed upstream of the medium temperature evaporator 310.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention is to cover all modifications, equivalents, and alternatives falling within the spirit and scope of the invention as defined by the following appended claims.

What is claimed is:

1. A refrigeration system comprising:

a gas cooler or a condenser configured to reject first heat from a first fluid that is at a first pressure and that is in a supercritical state or subcritical state;

an evaporator configured to absorb second heat into a second fluid that is at a second pressure that is lower than the first pressure and that is in a liquid state, a vapor state, or a two-phase mixture of liquid and vapor;

a rotary pressure exchanger configured to receive the first fluid from the gas cooler or the condenser, to receive the second fluid from the evaporator, and to exchange pressure, via a rotor of the rotary pressure exchanger, between the first fluid and the second fluid, wherein the second fluid is to exit the rotary pressure exchanger in the supercritical state or in the subcritical state, and wherein the first fluid is to exit the rotary pressure exchanger in the liquid state or in the two-phase mixture of liquid and vapor; and a high differential pressure, low flow, multi-phase leakage pump configured to pressurize leakage flow exiting a low pressure outlet of the rotary pressure exchanger and to pump the leakage flow to a high pressure inlet of the rotary pressure exchanger, and wherein the high differential pressure, low flow, multi-phase leakage pump is configured to pump the leakage flow in the liquid state, the supercritical state, or in the two-phase mixture of liquid and vapor.

2. The refrigeration system of claim 1 further comprising a high pressure, low differential pressure, multi-phase circulation pump disposed downstream of the gas cooler or the condenser and upstream of the high pressure inlet of the rotary pressure exchanger, wherein the high pressure, low differential pressure, multi-phase circulation pump is configured to pump the first fluid in the liquid state or in the two-phase mixture of liquid and vapor.

3. The refrigeration system of claim 2 further comprising a low pressure, low differential pressure, multi-phase circulation pump disposed upstream of the evaporator, wherein the low pressure, low differential pressure, multi-phase circulation pump is configure to pump the second fluid in the liquid state or the two-phase mixture of liquid and vapor to the evaporator.

4. The refrigeration system of claim 3 further comprising a first three-way valve disposed between the rotary pressure exchanger and the low pressure, low differential pressure, multi-phase circulation pump.

5. The refrigeration system of claim 4 further comprising a second three-way valve disposed between the rotary pressure exchanger and the high pressure, low differential pressure, multi-phase circulation pump.

6. The refrigeration system of claim 5, wherein the high differential pressure, low flow, multi-phase leakage pump is disposed between the first three-way valve and the second three-way valve.

7. The refrigeration system of claim 1, wherein the first fluid and the second fluid comprise carbon dioxide.

* * * * *